US010774397B2

(12) United States Patent
Yamamoto et al.

(10) Patent No.: US 10,774,397 B2
(45) Date of Patent: Sep. 15, 2020

(54) HEAT TREATMENT APPARATUS

(71) Applicant: Koyo Thermo Systems Co., Ltd., Nara (JP)

(72) Inventors: Ryosuke Yamamoto, Tenri (JP); Manabu Sato, Tenri (JP); Ayaka Nakata, Tenri (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 201 days.

(21) Appl. No.: 15/759,116

(22) PCT Filed: Jun. 13, 2016

(86) PCT No.: PCT/JP2016/067558

§ 371 (c)(1),
(2) Date: Mar. 9, 2018

(87) PCT Pub. No.: WO2017/043138

PCT Pub. Date: Mar. 16, 2017

(65) Prior Publication Data

US 2018/0282831 A1 Oct. 4, 2018

(30) Foreign Application Priority Data

Sep. 11, 2015 (JP) ..... 2015-179605

(51) Int. Cl.
*C21D 9/00* (2006.01)
*F27B 9/26* (2006.01)
(Continued)

(52) U.S. Cl.
CPC ..... *C21D 9/0062* (2013.01); *C21D 1/00* (2013.01); *C21D 9/0056* (2013.01); *F27B 9/02* (2013.01);
(Continued)

(58) Field of Classification Search
CPC ..... C21D 1/00; C21D 9/0056; C21D 9/0062; F27B 9/02; F27B 9/12; F27B 9/26; F27D 3/12
(Continued)

(56) References Cited

U.S. PATENT DOCUMENTS 5,002,009 A * 3/1991 Hayami ..... C21D 9/0062 118/676
7,090,488 B2 8/2006 Murakami et al.
(Continued)

FOREIGN PATENT DOCUMENTS

CN 1926249 A 3/2007
CN 102089610 A 6/2011
(Continued)

OTHER PUBLICATIONS

An Office Action mailed by the State Intellectual Property Office of the People's Republic of China dated Jan. 18, 2019, which corresponds to Chinese Patent Application No. 201680051793.7 and is related to U.S. Appl. No. 15/759,116.
(Continued)

*Primary Examiner* — Scott R Kastler
*Assistant Examiner* — Michael Aboagye
(74) *Attorney, Agent, or Firm* — Studebaker & Brackett PC

(57) ABSTRACT

A heat treatment apparatus 1 includes a coolant passage defining body 42 to define a coolant passage 48 to supply a coolant to a workpiece 100. The coolant passage defining body 42 includes an upper member 50 and a lower member 40 as a plurality of coolant passage defining members, and is configured so that, by displacing these members 49 and 50 so as to approach each other along an up-down direction Z1 crossing a conveyance direction, the coolant passage 48 is defined in a state housing the workpiece 100. In addition, the
(Continued)

coolant passage defining body is configured so that, by displacing the members 49 and 50 described above so as to separate from each other along the up-down direction Z1, the workpiece 100 is allowed to be let into and out of the coolant passage 48 along the conveyance direction A1.

6 Claims, 17 Drawing Sheets

(51) Int. Cl.
*F27D 3/12* (2006.01)
*F27B 9/12* (2006.01)
*F27B 9/02* (2006.01)
*C21D 1/00* (2006.01)

(52) U.S. Cl.
CPC ..... *F27B 9/12* (2013.01); *F27B 9/26* (2013.01); *F27D 3/12* (2013.01)

(58) Field of Classification Search
USPC ..... 266/258, 250, 259, 277, 252; 432/128, 432/121, 207, 77, 81
See application file for complete search history.

(56) References Cited

U.S. PATENT DOCUMENTS

| | | | | |
|---|---|---|---|---|
| 8,715,565 | B2 * | 5/2014 | Sugiyama | B21B 45/0215 148/638 |
| 2005/0158685 | A1 | 7/2005 | Murakami et al. | |
| 2011/0262877 | A1 | 10/2011 | Katsumata | |
| 2014/0131930 | A1 | 5/2014 | Katsumata | |

FOREIGN PATENT DOCUMENTS

| | | | |
|---|---|---|---|
| CN | 203964647 | U | 11/2014 |
| EP | 0 284 233 | A1 | 9/1988 |
| EP | 1 643 199 | A1 | 4/2006 |
| EP | 1 726 665 | A1 | 11/2006 |
| EP | 1 801 529 | A1 | 6/2007 |
| JP | H01-249641 | A | 10/1989 |
| JP | 2000-111266 | A | 4/2000 |
| JP | 2003-240440 | A | 8/2003 |
| JP | 2003-343981 | A | 12/2003 |
| JP | 2005-213646 | A | 8/2005 |
| JP | 2006-066616 | A | 3/2006 |
| JP | 2006-266616 | A | 10/2006 |
| JP | 2010-038531 | A | 2/2010 |

OTHER PUBLICATIONS

The extended European search report issued by the European Patent Office dated Jan. 18, 2019, which corresponds to European Patent Application No. 16844004.8-1103 and is related to U.S. Appl. No. 15/759,116.

International Search Report issued in PCT/JP2016/067558; dated Sep. 6, 2016.

An Office Action; "Notification of Reasons for Refusal," dated by the Japanese Patent Office on Sep. 19, 2017, which corresponds to Japanese Patent Application No. 2017-535730.

An Office Action mailed by the State Intellectual Property Office of People's Republic of China dated Aug. 5, 2019, which corresponds to Chinese Patent Application No. 201680051793.7 and is related to U.S. Appl. No. 15/759,116.

An Office Action mailed by the European Patent Office dated Feb. 12, 2020, which corresponds to European Patent No. 16 844 004.8-1103.

An Office Action issued by the Indonesian Patent Office dated Mar. 31, 2020, which corresponds to Indonesian Patent Application No. PID201802602 and is related to U.S. Appl. No. 15/759,116; with partial English language translation and concise explanation.

* cited by examiner

HEAT TREATMENT APPARATUS

TECHNICAL FIELD

The present invention relates to a heat treatment apparatus for applying heat treatment and cooling treatment to a workpiece.

BACKGROUND ART

For example, a heat treatment apparatus for applying heat treatment to a metallic component (workpiece), etc., is known (for example, refer to Patent Application Document 1). A quenching device as a heat treatment apparatus described in Patent Application Document 1 is configured to apply quenching treatment (rapid cooling) to a heated workpiece. In the rapid cooling treatment, the workpiece is disposed within a portion extending vertically in a duct. Then, by a coolant passing through this duct, the workpiece is cooled.

CITATION LIST

Patent Application Document

Patent Application Document: Japanese Unexamined Patent Application Publication No. 2005-213646

SUMMARY OF THE INVENTION

Technical Problem

A workpiece is let into and out of a duct by being displaced along an axial direction (up-down direction) of an opening of the duct. In the configuration described in Patent Application Document 1, a heating furnace is disposed above the duct. Therefore, the heating furnace, a conveyance path to convey the workpiece from the heating furnace to the duct, and the duct are arranged vertically, and this increases the size of the apparatus.

In view of the circumstances described above, an object of the present invention is to provide a heat treatment apparatus capable of being configured to be more compact.

Solution to Problem (1) In order to solve the above-described problem, a heat treatment apparatus according to an aspect of the present invention includes a coolant passage defining body to define a coolant passage to supply a predetermined coolant to a workpiece passing through a conveyance path along a predetermined conveyance direction, wherein the coolant passage defining body includes a plurality of coolant passage defining members, and the plurality of coolant passage defining members are configured to define the coolant passage in a state of housing the workpiece by being displaced to approach each other along a predetermined crossing direction crossing the conveyance direction, and configured to allow the workpiece to be let into and out of the coolant passage along the conveyance direction by being displaced to separate from each other along the crossing direction.

With this configuration, an extending direction of the coolant passage and the conveyance direction of the workpiece are different from each other. Accordingly, the shape of the heat treatment apparatus can be prevented from becoming excessively long in any of the extending direction of the coolant passage and the conveyance direction. Therefore, the heat treatment apparatus can be made more compact. In addition, by relatively displacing the plurality of coolant passage defining members to separate from each other in a predetermined crossing direction, the workpiece is enabled to be let into and out of the coolant passage. Therefore, it is not necessary to provide a robot arm, etc., to let the workpiece into and out of the coolant passage. Accordingly, the heat treatment apparatus can be made more compact.

(2) Preferably, the coolant passage extends along the crossing direction, the crossing direction includes an up-down direction of the heat treatment apparatus, and the coolant passage is configured so that a cooling liquid as the coolant flows upward from a lower side in the coolant passage.

With this configuration, the crossing direction and the conveyance direction are disposed orthogonal to each other. Accordingly, the coolant passage defining body can be formed to be vertically long, so that the size of the heat treatment apparatus in the horizontal direction can be made smaller. In addition, since an extending direction of a supply pipe and the conveyance direction are orthogonal to each other, the heat treatment apparatus can be prevented from being shaped excessively large in each of the horizontal direction and the vertical direction. Therefore, the heat treatment apparatus can be made more compact. Further, in the coolant passage, a coolant flows upward from the lower side, so that the coolant can be more uniformly moved up. Accordingly, the workpiece can be more uniformly cooled.

(3) More preferably, the heat treatment apparatus further includes a conveyance tray to convey the workpiece along the conveyance direction, wherein the conveyance tray cooperates with the plurality of coolant passage defining members, which is configured to define the coolant passage.

With this configuration, the conveyance tray defines apart of the coolant passage. Accordingly, an exclusive member to support the conveyance tray inside the coolant passage is unnecessary, so that the heat treatment apparatus can be configured to be more compact and simpler.

(4) More preferably, the conveyance tray is configured to be disposed between the plurality of coolant passage defining members, and the conveyance tray includes a support portion to support the workpiece, and a hole portion to make the coolant pass through.

With this configuration, the workpiece is disposed at an intermediate portion of the coolant passage. Then, a coolant is supplied to this workpiece through the hole portion. Accordingly, the workpiece is reliably cooled by the coolant while being reliably supported inside the coolant passage.

(5) Preferably, the plurality of coolant passage defining members include an upper member and a lower member disposed below the upper member, and the heat treatment apparatus further includes a vertical displacement mechanism to displace the upper member in the up-down direction with respect to the lower member.

With this configuration, by displacing the upper member to the lower member side by the vertical displacement mechanism, a coolant passage is formed. In addition, by moving up the upper member away from the lower member by the vertical displacement mechanism, a workpiece can be exposed from the coolant passage defining body. This enables letting-in and letting-out of the workpiece along the conveyance direction.

(6) More preferably, the heat treatment apparatus further includes a conveyance mechanism to displace the conveyance tray along the conveyance direction, wherein the conveyance mechanism includes a unit configured to be displaceable to a predetermined conveyance position and a predetermined cooling position by the vertical displacement mechanism, and the unit positioned at the conveyance position supports the conveyance tray so that the conveyance tray is away from the upper member and the lower member, and the unit positioned at the cooling position disposes the conveyance tray so that the conveyance tray comes into contact with the lower member.

With this configuration, when the unit is disposed at the conveyance position, the unit can support the conveyance tray in a state where this conveyance tray does not collide with other members. Accordingly, the conveyance tray can be smoothly conveyed. On the other hand, when the unit is disposed at the cooling position, the conveyance tray can be disposed so as to define a coolant passage in cooperation with the lower member. Thus, the vertical displacement mechanism not only simply displaces the upper member vertically with respect to the lower member, but also displaces the unit and the conveyance tray vertically.

(7) More preferably, the vertical displacement mechanism is configured to displace the upper member to bring the upper member into contact with the conveyance tray when the conveyance tray is positioned at the cooling position.

With this configuration, by displacing the upper member downward by the vertical displacement mechanism, the upper member and the lower member can be made to sandwich the conveyance tray. As a result, a coolant passage can be defined by cooperation of the upper member, the conveyance tray, and the lower member.

(8) Preferably, the heat treatment apparatus further includes a rectifying member to rectify the coolant inside the coolant passage.

With this configuration, a larger amount of coolant can be more uniformly brought into contact with a workpiece per unit time, so that distortion of the workpiece can be suppressed.

Effect of the Invention

According to the present invention, a more compact heat treatment apparatus can be realized.

EMBODIMENTS OF THE INVENTION

Hereinafter, an embodiment to carry out the present invention is described with reference to the drawings. The present invention can be widely applied as a heat treatment apparatus for applying heat treatment to a workpiece.

Figure 1:
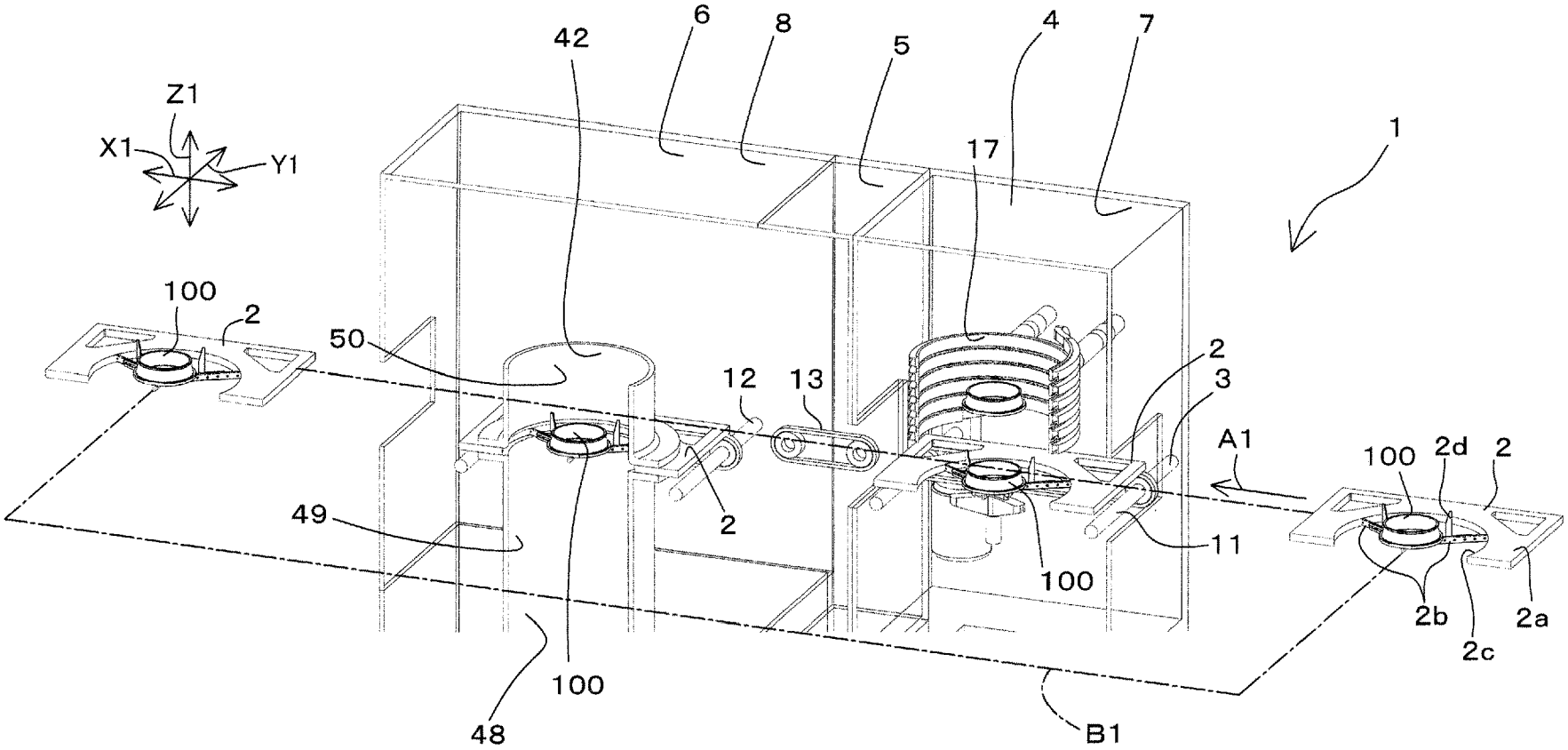
FIG. 1 is a schematic and conceptual perspective view of a heat treatment apparatus, partially cut away.
Figure 2:
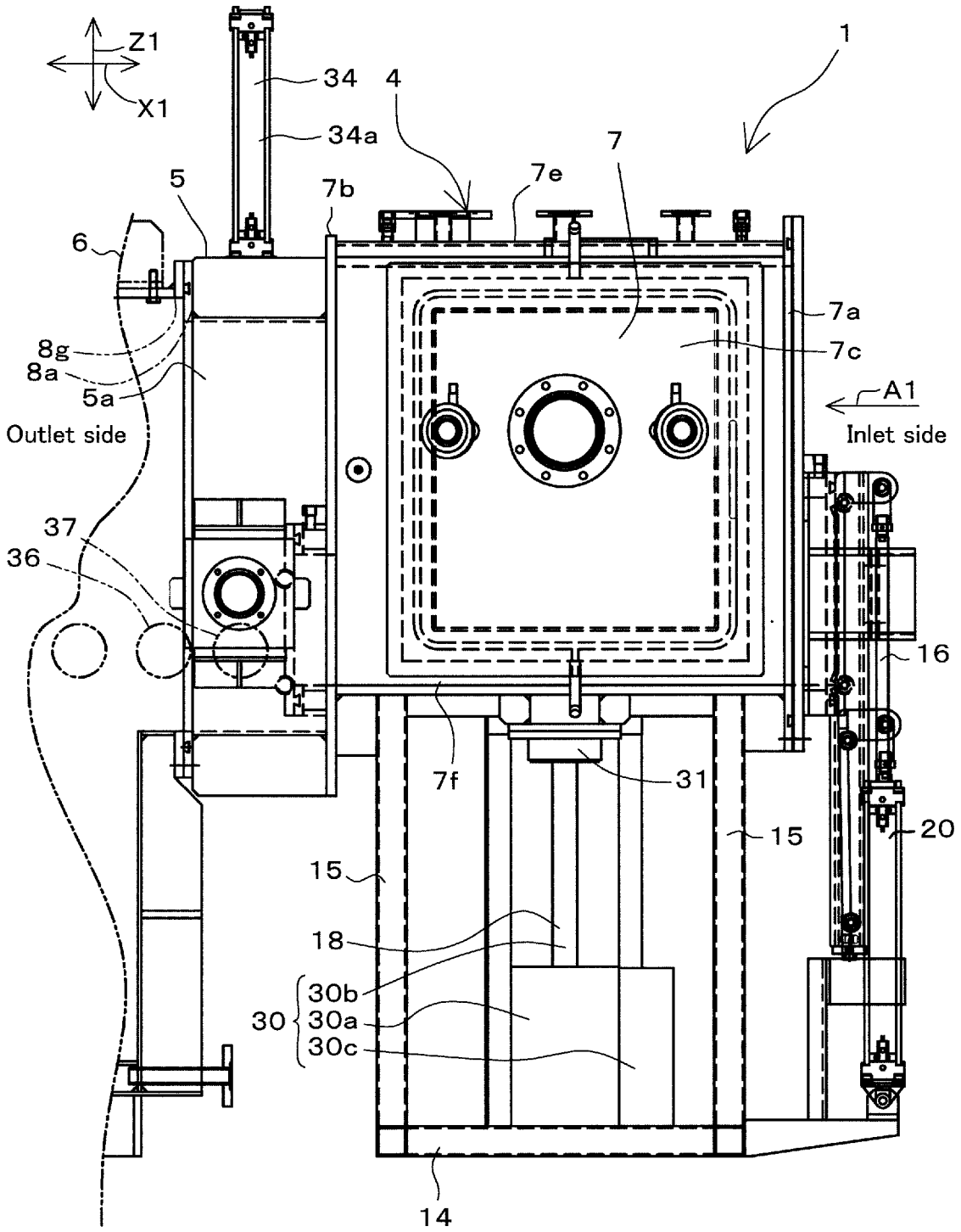
FIG. 2 is a front view of a heating device of the heat treatment apparatus.
Figure 3:
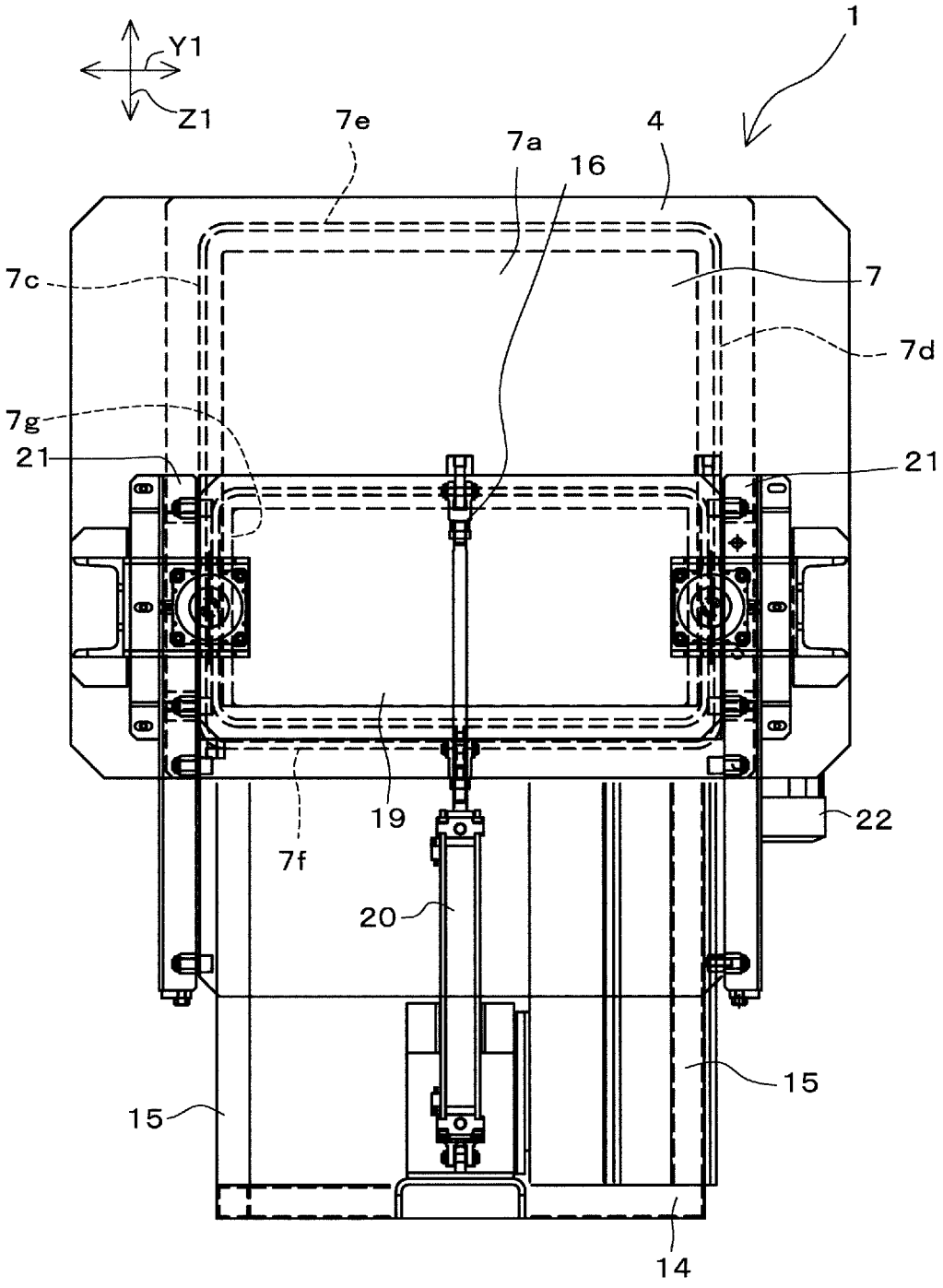
FIG. 3 is an inlet-side side view of the heating device.
Figure 4:
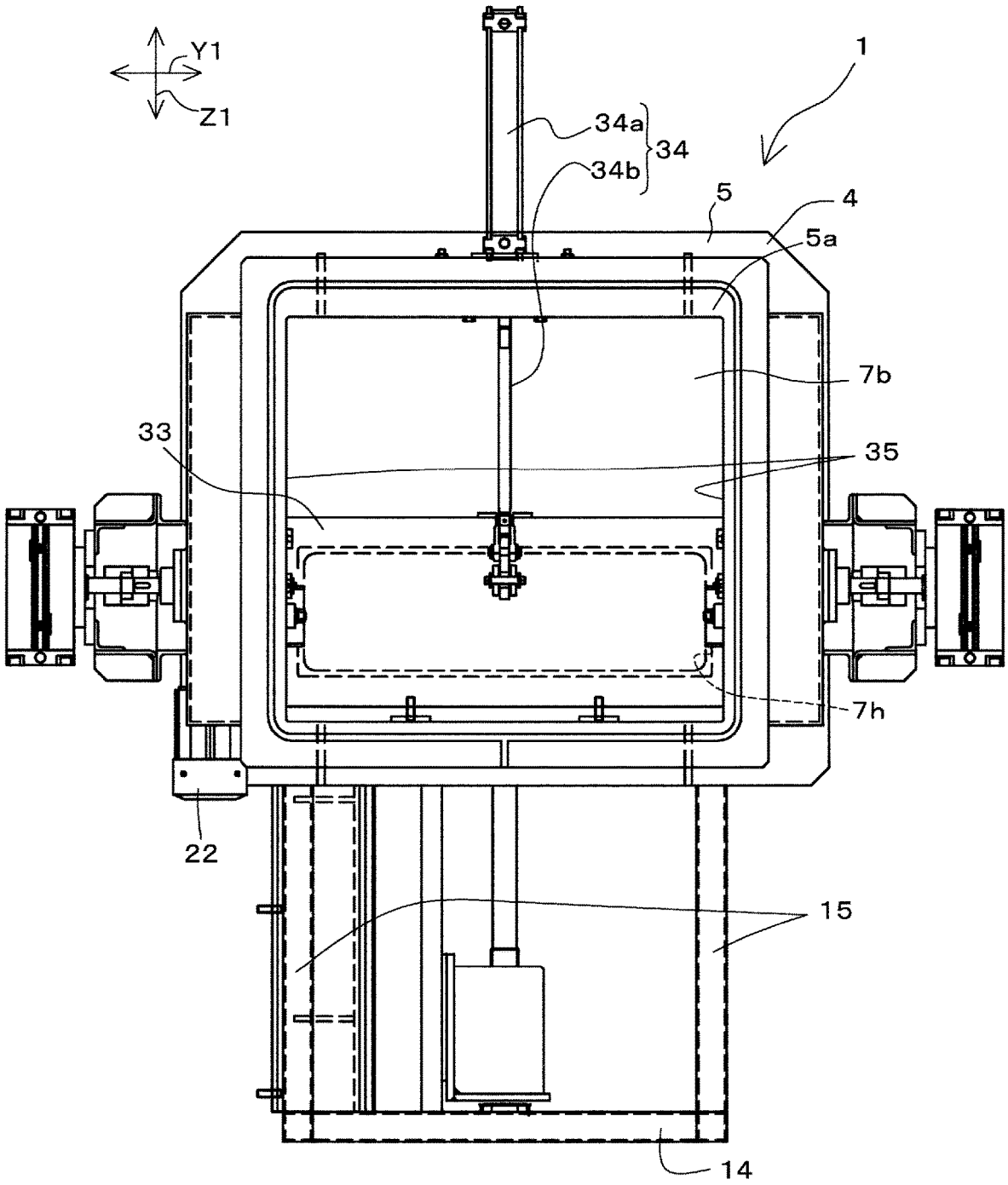
FIG. 4 is an outlet-side side view of the heating device.
Figure 5:
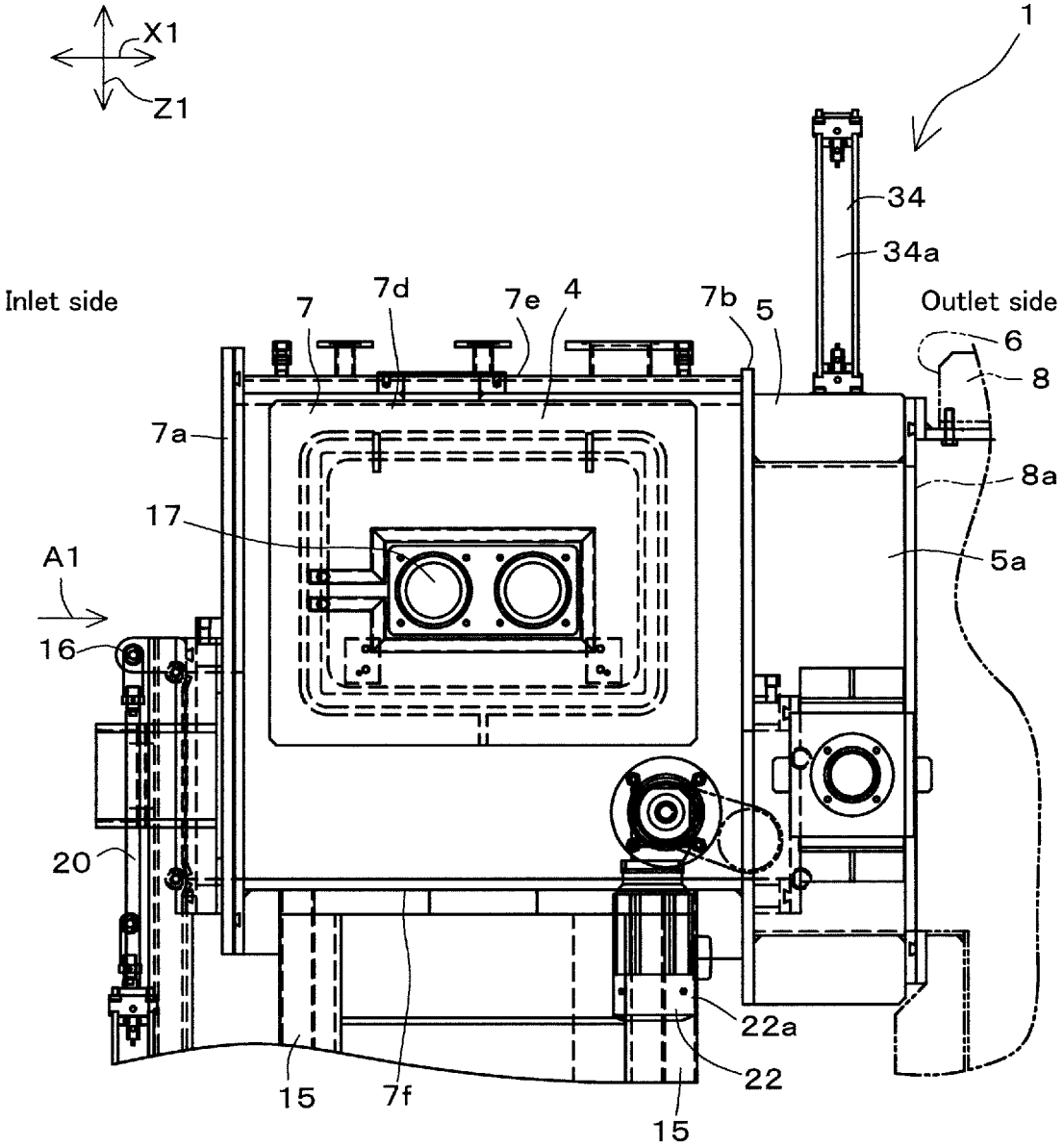
FIG. 5 is a back view of the heating device.
Figure 6:
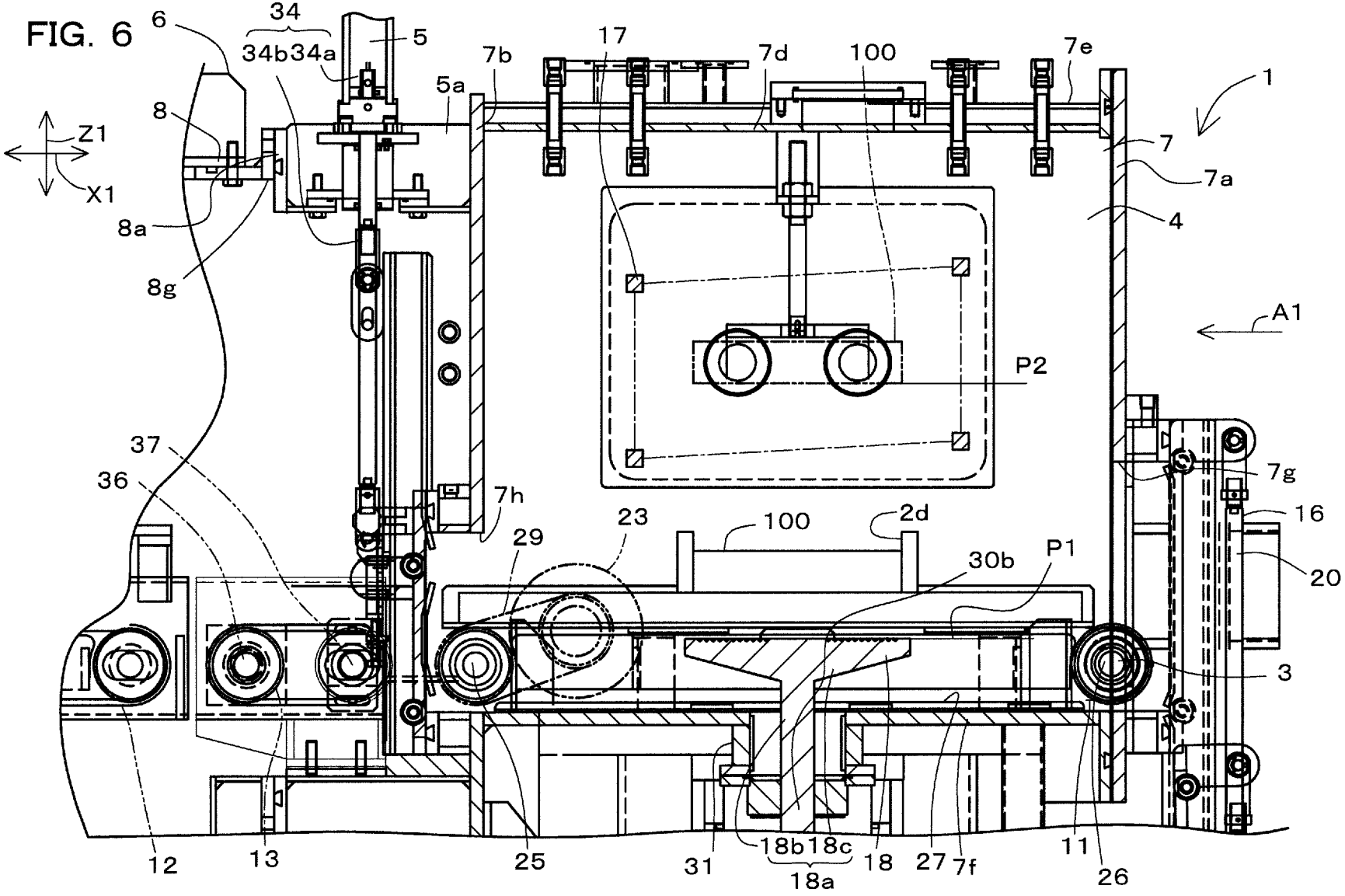
FIG. 6 is a partial sectional view of a major portion of the heating device, viewed from a front side.
Figure 7:
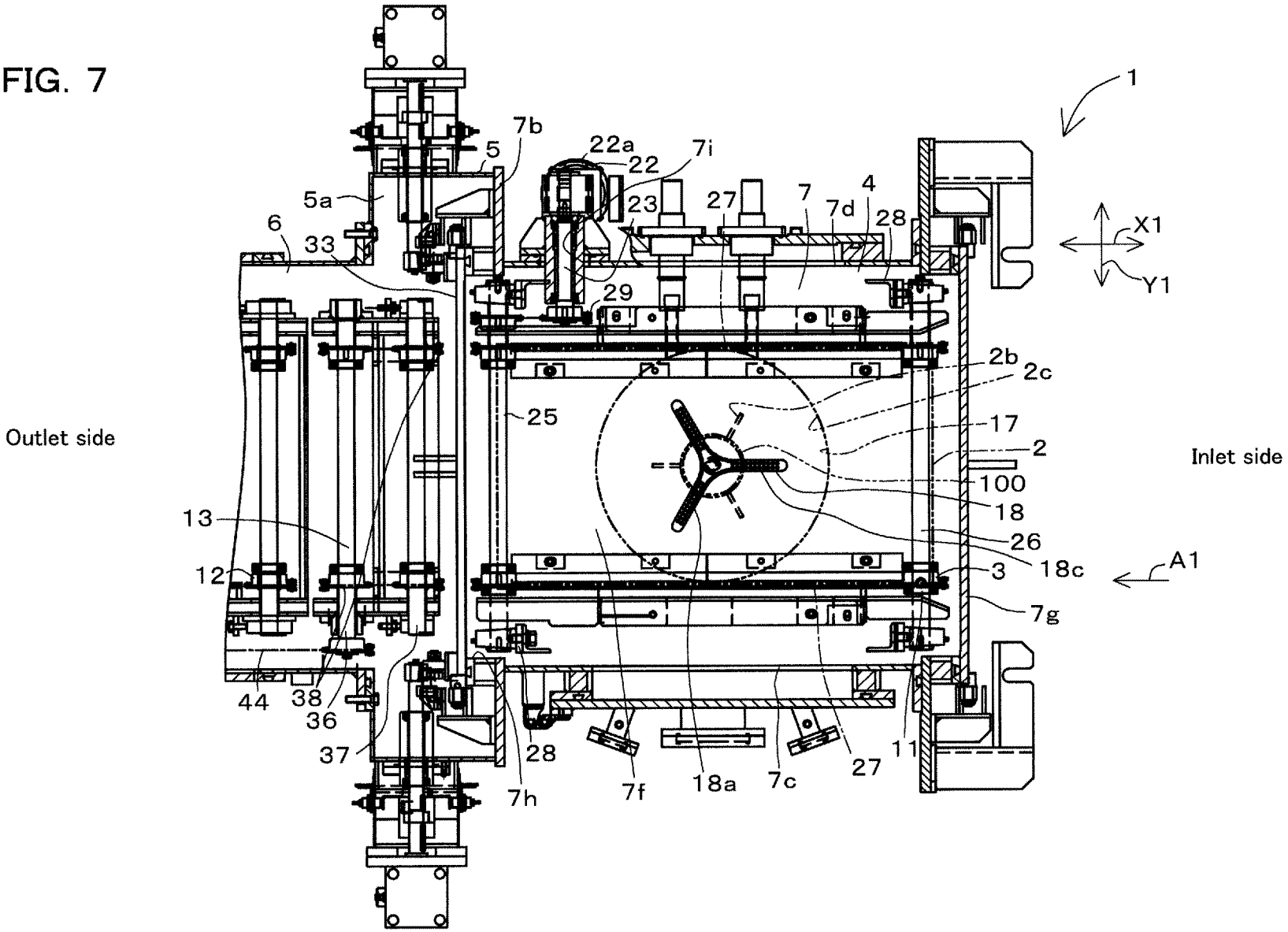
FIG. 7 is a sectional view in a state where the major portion of the heating device is shown in a plan view.
Figure 8:
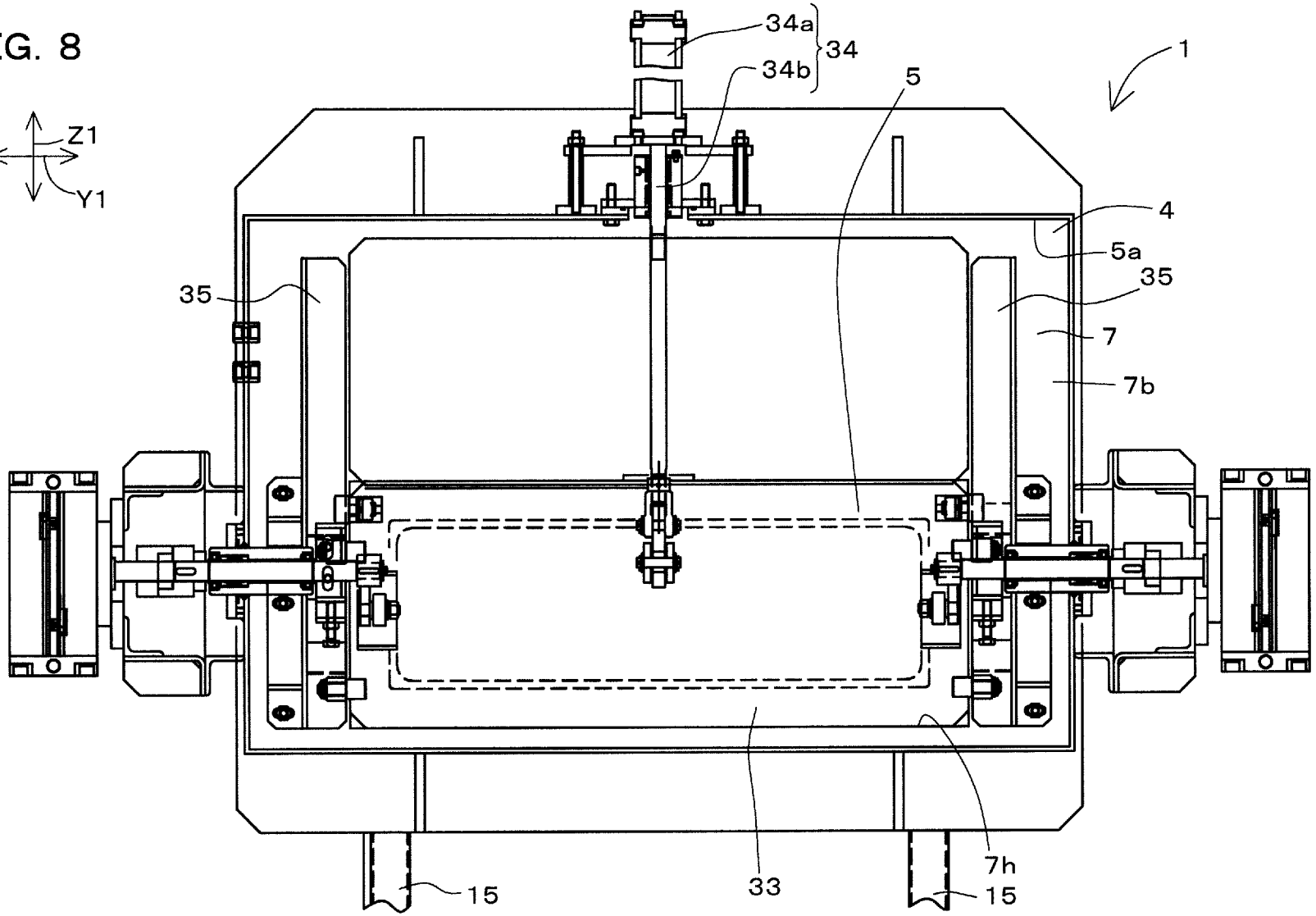
FIG. 8 is a side view of an outlet side of an intermediate door unit of the heat treatment apparatus.

FIG. 1 is a schematic and conceptual perspective view of a heat treatment apparatus 1, partially cut away. FIG. 2 is a front view of a heating device 4 of the heat treatment apparatus 1. FIG. 3 is an inlet-side side view of the heating device 4. FIG. 4 is an outlet-side side view of the heating device 4. FIG. 5 is a back view of the heating device 4. FIG. 6 is a partial sectional view of a major portion of the heating device 4, viewed from the front side. FIG. 7 is a sectional view in a state where the major portion of the heating device 4 is shown in a plan view. FIG. 8 is a side view of an outlet side of an intermediate door unit 5 of the heat treatment apparatus 1.

Figure 9:
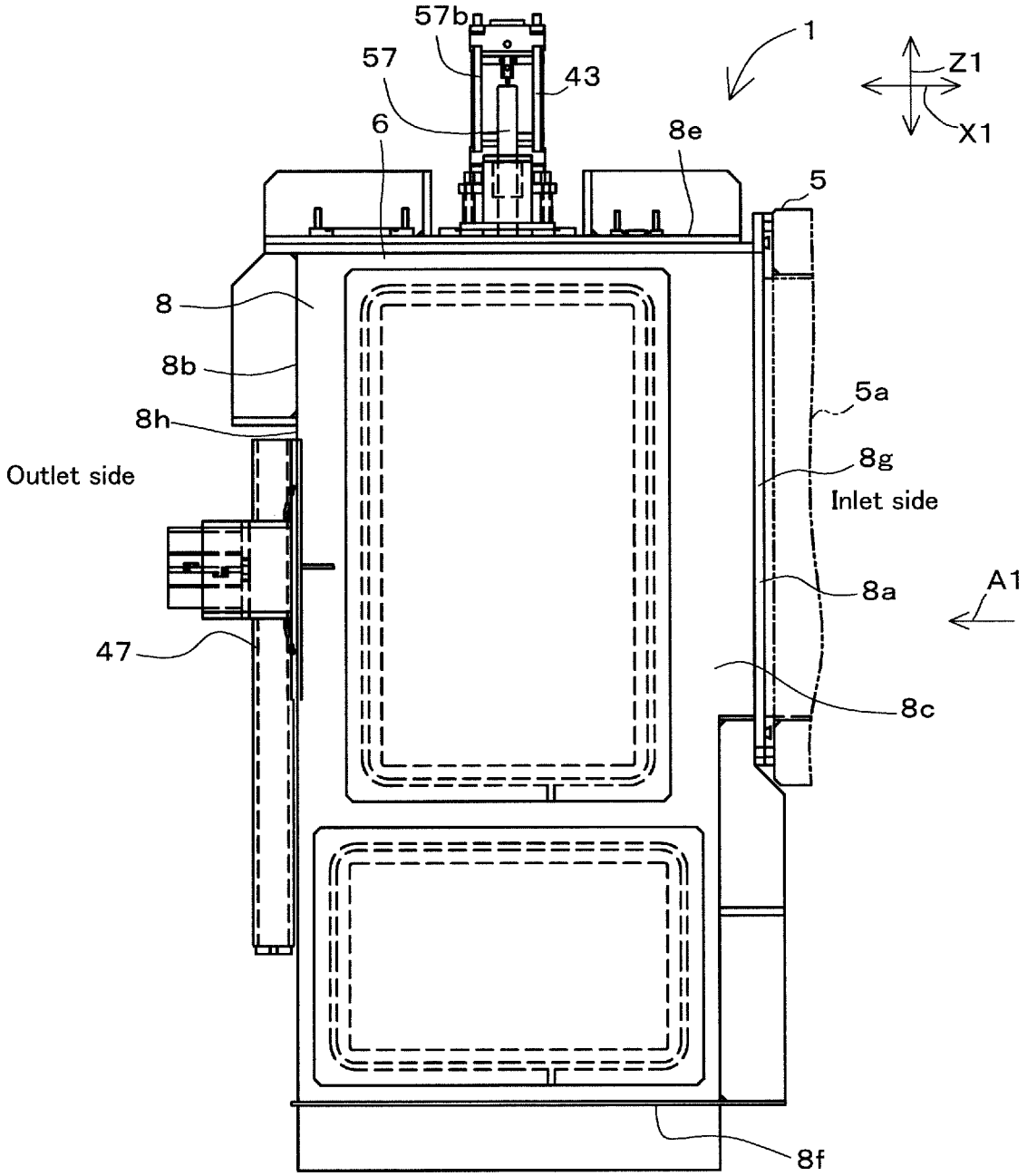
FIG. 9 is a front view of a cooling device of the heat treatment apparatus.
Figure 10:
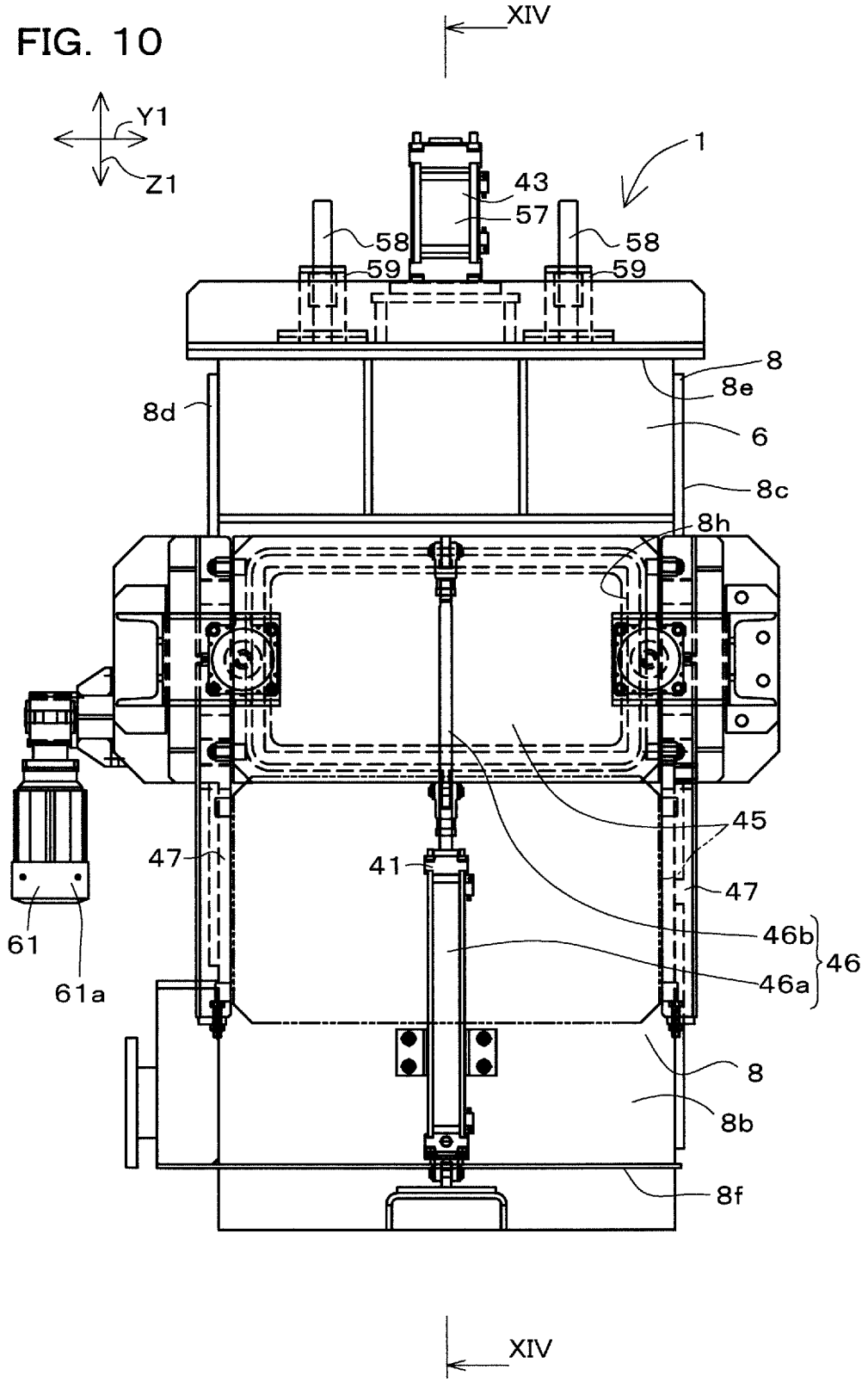
FIG. 10 is a side view of an outlet side of the cooling device.
Figure 11:
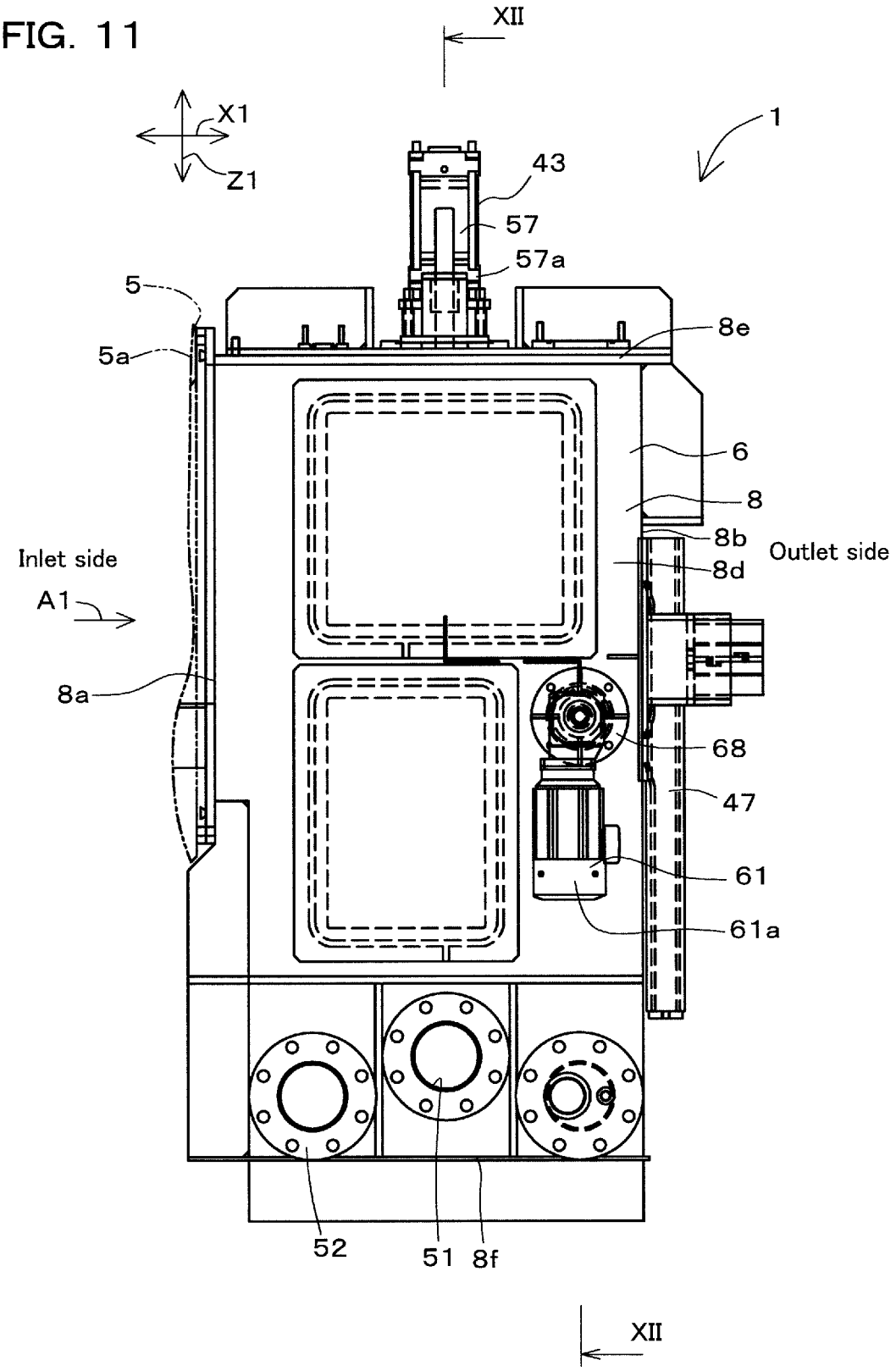
FIG. 11 is a back view of the cooling device.
Figure 12:
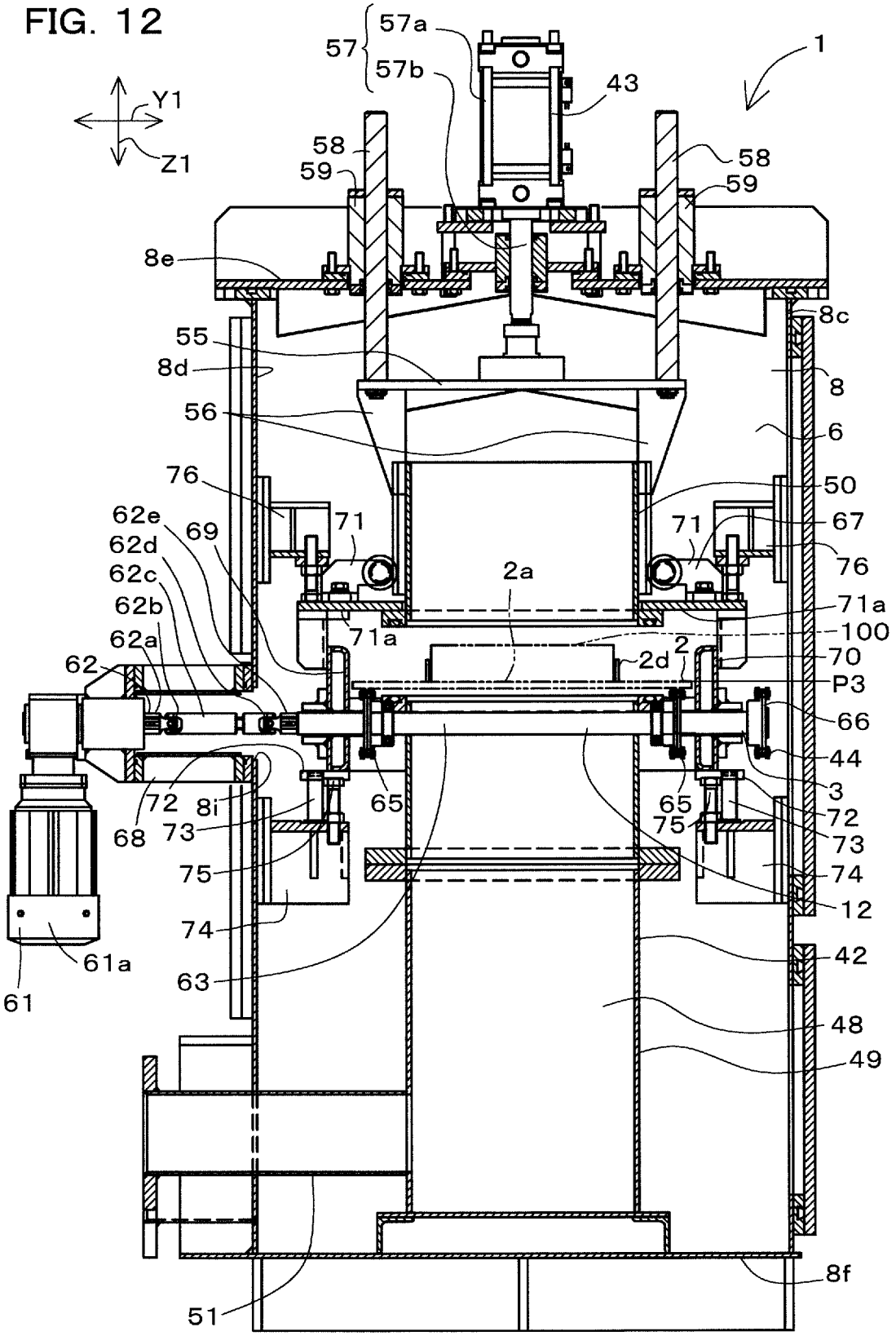
FIG. 12 is a sectional view taken along line XII-XII in FIG. 11, showing a section orthogonal to a conveyance direction of a work piece.
Figure 13:
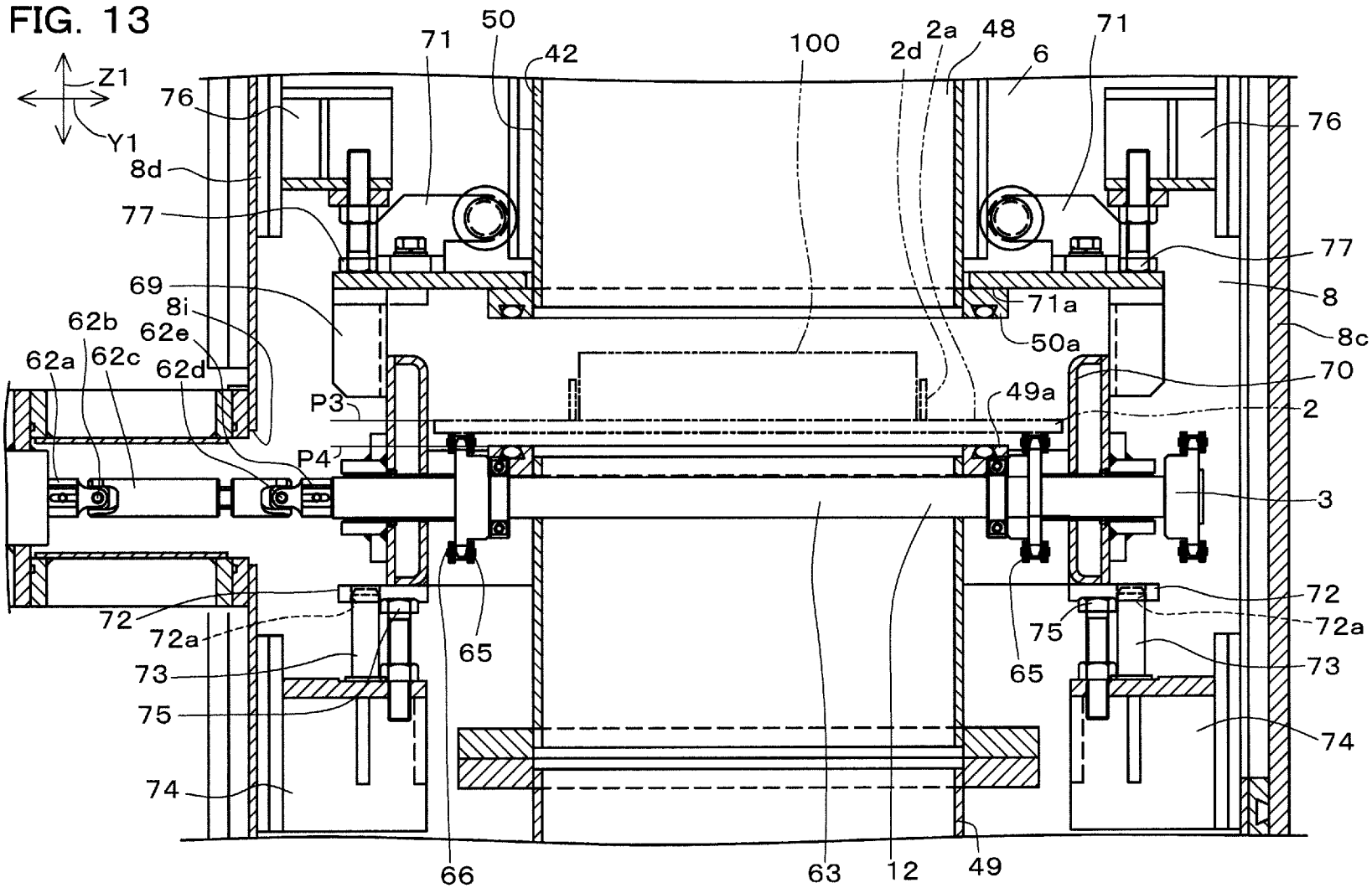
FIG. 13 is an enlarged view of a major portion of FIG. 12.
Figure 14:
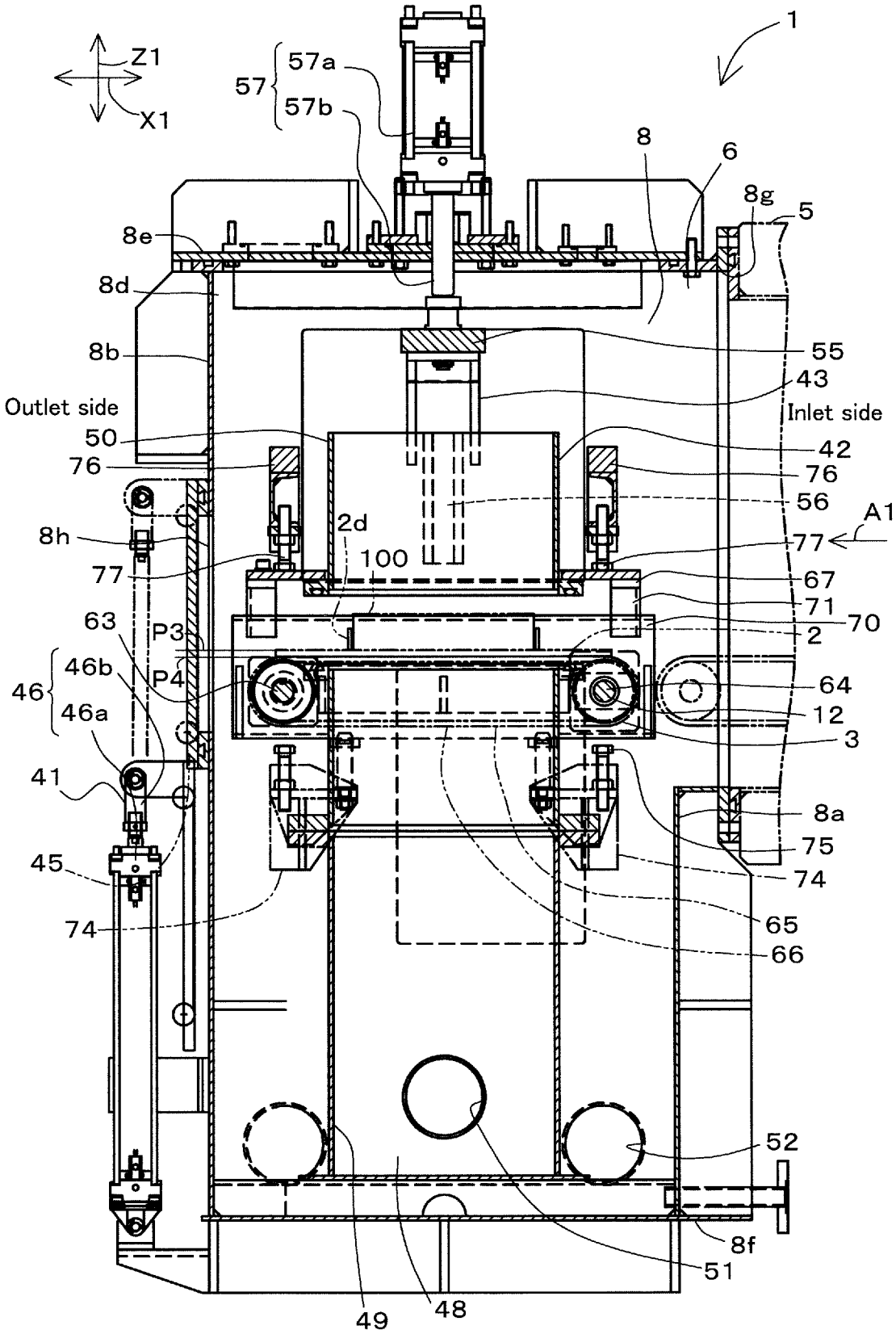
FIG. 14 is a sectional view taken along line XIV-XIV in FIG. 10, showing the cooling device viewed from the front side.
Figure 15:
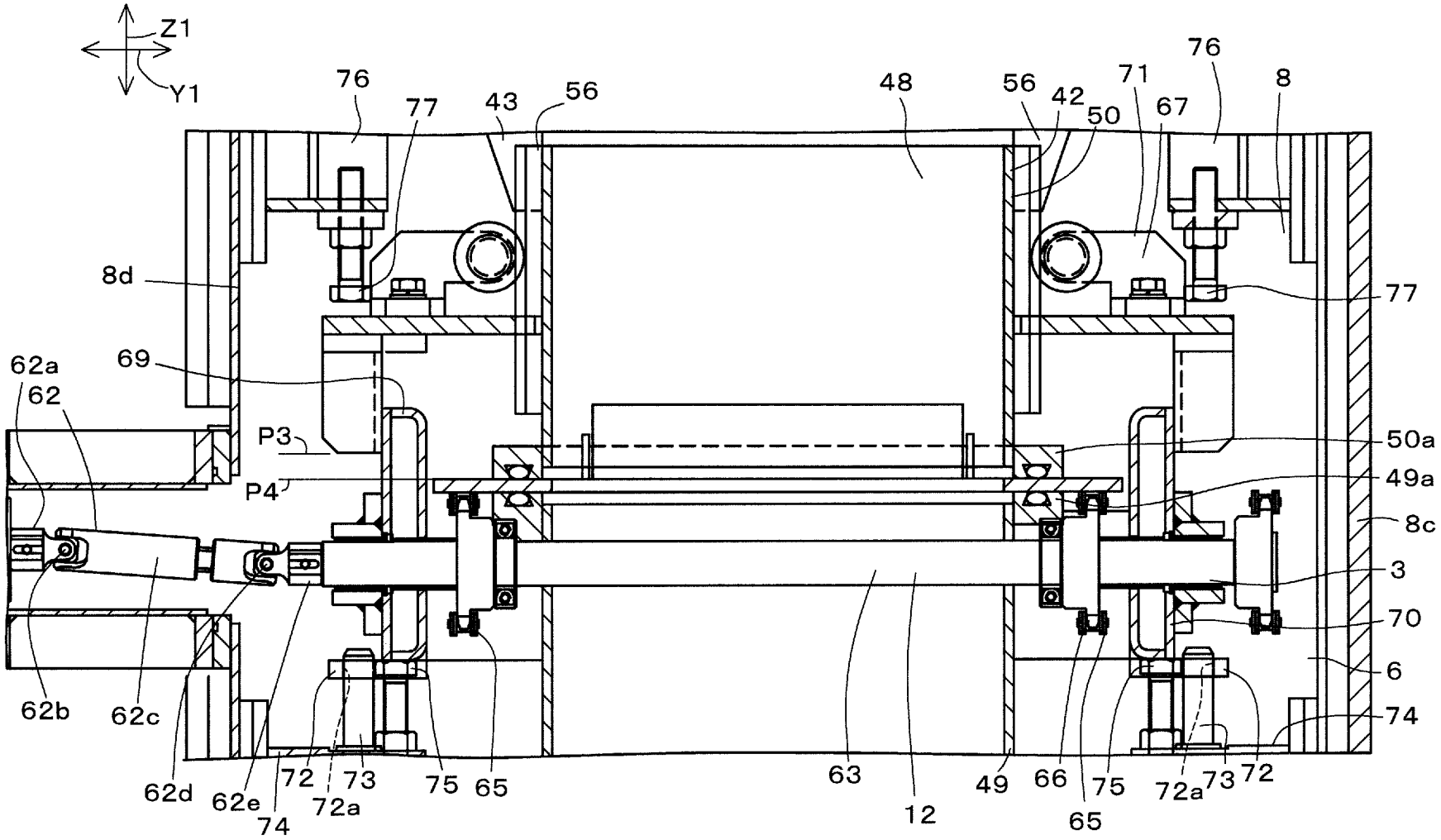
FIG. 15 is a view to describe a cooling treatment operation in the cooling device.
Figure 16:
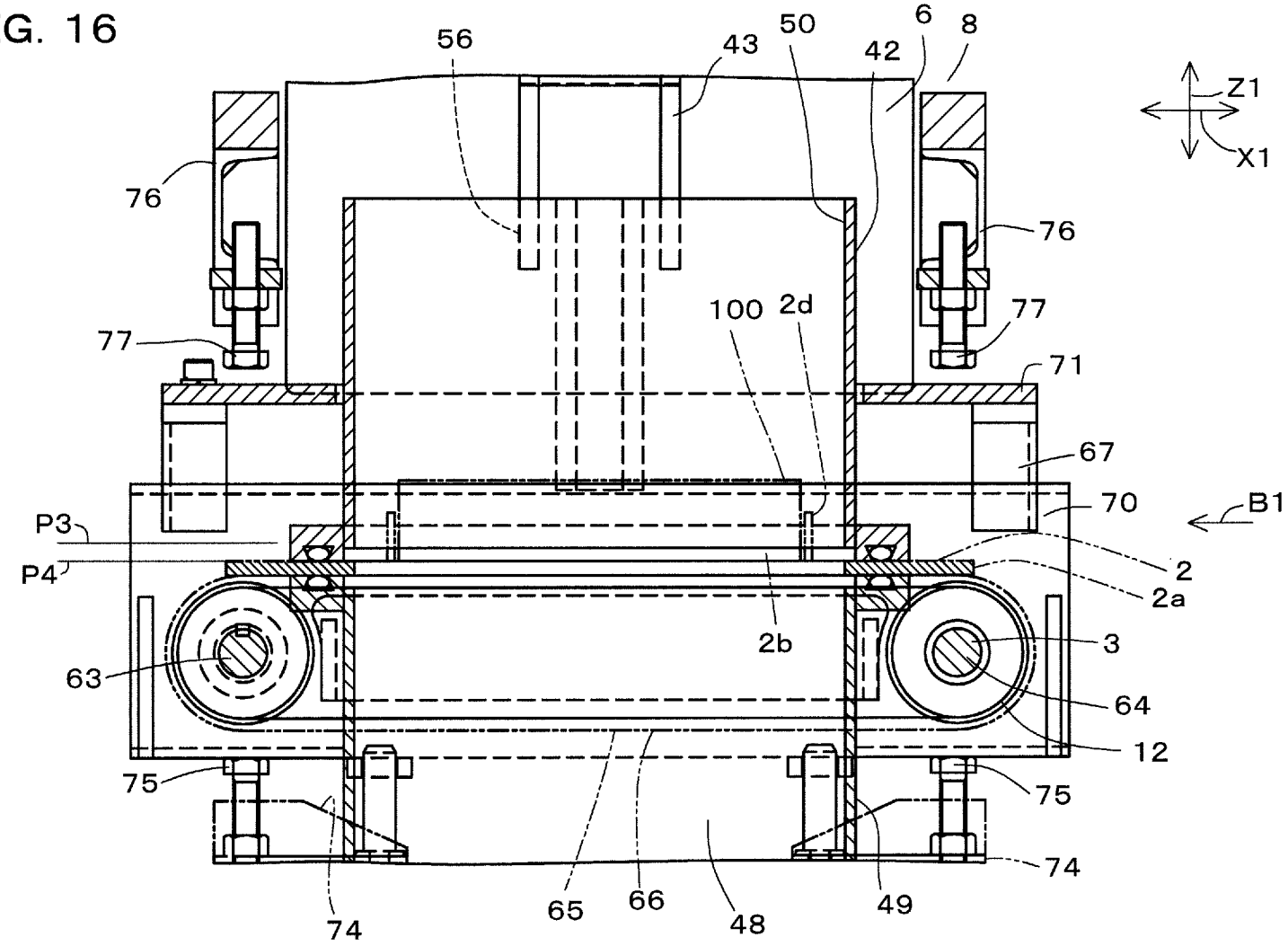
FIG. 16 is a view to describe a cooling treatment operation in the cooling device.

FIG. 9 is a front view of a cooling device 6 of the heat treatment apparatus 1. FIG. 10 is aside view of an outlet side of the cooling device 6. FIG. 11 is a back view of the cooling device 6. FIG. 12 is a sectional view taken along line XII-XII in FIG. 11, showing a section orthogonal to a conveyance direction A1 of a workpiece 100. FIG. 13 is an enlarged view of a major portion of FIG. 12. FIG. 14 is a sectional view taken along line XIV-XIV in FIG. 10, showing the cooling device 6 viewed from the front side. FIG. 15 and FIG. 16 are views to describe a cooling treatment operation in the cooling device 6.

Hereinafter, based on a state where the heat treatment apparatus 1 is viewed from the front, the left-right direction X1 (conveyance direction A1), the front-rear direction Y1, and the up-down direction Z1 are prescribed.

Referring to FIG. 1 and FIG. 2, the heat treatment apparatus 1 is provided for applying heat treatment to the workpiece 100. This heat treatment includes heat applying treatment and cooling treatment. Examples of heat applying treatment include carburizing heat treatment and heat equalizing treatment, etc. Examples of cooling treatment include quenching treatment, etc. Detailed examples of heat applying treatment and cooling treatment to be performed in the heat treatment apparatus 1 are not particularly limited. In the present embodiment, the workpiece 100 is a metallic component, for example, a gear.

The heat treatment apparatus 1 includes a conveyance tray 2, a first conveyance mechanism 3, a heating device 4, an intermediate door unit 5, and a cooling device 6.

The conveyance tray 2 is a conveyance support member to support the workpiece 100. The conveyance tray 2 is, in the present embodiment, a member made of metal or carbon, and is repeatedly used in heat treatment of the workpiece 100 in the heat treatment apparatus 1. The conveyance tray 2 conveys the workpiece 100 along a predetermined conveyance direction A1 extending along the horizontal direction. In the present embodiment, when heat applying treatment is applied to the workpiece 100 in the heating device 4, the conveyance tray 2 is away from the workpiece 100 so as to be prevented from being exposed to high heat from the heating device 4.

The conveyance tray 2 includes a frame portion 2*a* and support portions 2*b*.

The frame portion 2*a* is provided as a portion to be supported by the first conveyance mechanism 3. The frame portion 2*a* is formed into, for example, a plate shape having a rectangular external form and a predetermined thickness. The frame portion 2*a* is formed to have a size that can be housed inside the heating device 4 and housed inside the cooling device 6. At a central portion of the frame portion 2*a*, a hole portion 2*c* (opening) is formed. This hole portion 2*c* is formed to be, for example, circular, and penetrates through the frame portion 2*a* in a thickness direction of the frame portion 2*a*. This hole portion 2*c* is provided to move up and down the workpiece 100 in the heating device 4, and provided to allow a coolant to pass through in the cooling device 6.

For example, from an inner circumferential portion of the hole portion 2*c* toward a center of the hole portion 2*c*, a plurality of support portions 2*b* extend. The support portions 2*b* are provided as portions to support the work piece 100. The support portions 2*b* are provided in plural (in the present embodiment, three) at even intervals in the circumferential direction of the hole portion 2*c*. Each support portion 2*b* extends from the rim of the hole portion 2*c* toward the central portion of the hole portion 2*c*. Tip ends of these support portions 2*b* are away from each other so as not to block an operation of lifting the workpiece 100 by a second conveyance mechanism 18 described below.

On each support portion 2*b*, a positioning projection 2*d* to position (center) the workpiece 100 is provided. The projections 2*d* are disposed to receive an outer circumferential surface of the workpiece 100, and extend upward. The workpiece 100 is preferably placed on the support portions 2*b* by point contact or linear contact. The support portions 2*b* function as rectifying members to rectify a coolant in a coolant passage 48 as described below. Batch treatment can be performed by stacking a plurality of workpieces 100 on the conveyance tray 2.

The conveyance tray 2 configured as described above is conveyed along the conveyance direction A1 to the heating device 4 and the cooling device 6 by the first conveyance mechanism 3. The first conveyance mechanism 3 is provided to convey the conveyance tray 2 along a predetermined conveyance path B1 from the outside of the heating device 4 to the outside of a cooling chamber 8 through a heating chamber 7 of the heating device 4 and the cooling chamber 8 of the cooling device 6. This first conveyance mechanism 3 is configured to circulate the conveyance tray 2 along the conveyance path B1 to the outside of the heating device 4, the inside of the heating chamber 7 of the heating device 4, the inside of the cooling chamber 8 of the cooling device 6, and the outside of the cooling chamber 8.

Referring to FIG. 1 to FIG. 7, the first conveyance mechanism 3 includes a heating chamber-side conveyance portion 11 disposed in the heating chamber 7 to convey the conveyance tray 2 along the conveyance path B1, a cooling chamber-side conveyance portion 12 disposed in the cooling chamber 8 at a position away from the heating chamber-side conveyance portion 11 to convey the conveyance tray 2 along the conveyance path B1, and an intermediate conveyance portion 13 disposed between the heating chamber-side conveyance portion 11 and the cooling chamber-side conveyance portion 12.

The heating chamber-side conveyance portion 11 is provided to convey the conveyance tray 2 inside the heating chamber 7. The cooling chamber-side conveyance portion 12 is provided to convey the conveyance tray 2, that passed through the heating chamber 7, inside the cooling chamber 8. The intermediate conveyance portion 13 is provided to dispose the conveyance tray 2 along the conveyance direction A1 in an intermediate door unit 5. Details of the first conveyance mechanism 3 are described below.

The heating device 4 includes the heating chamber 7, a bottom portion 14, columnar supports 15, an inlet door unit 16, a heating member 17, and a second conveyance mechanism 18.

The bottom portion 14 is provided as a base member of the heating device 4. The bottom portion 14 is formed to be rectangular in a plan view, and from the bottom portion 14, a plurality of columnar supports 15 extend upward. The columnar supports 15 support the heating chamber 7.

The heating chamber 7 is provided to provide heat energy to the workpiece 100. The heating chamber 7 is formed into a rectangular parallelepiped box shape. For example, the heating chamber 7 is configured for applying, in a state vacuated by a vacuum pump not shown in the drawings, heat treatment to the workpiece 100. The heating chamber 7 has an inlet wall 7*a*, an outlet wall 7*b*, a front wall 7*c*, a rear wall 7*d*, a top wall 7*e*, and a bottom wall 7*f*.

In the inlet wall 7*a*, an inlet 7*g* (opening) to introduce the workpiece 100 into the heating chamber 7 is formed. The inlet 7*g* is disposed close to a lower portion of the inlet wall 7*a*, extends to be long and narrow from the front wall 7*c* side to the rear wall 7*d* side, and allows the workpiece 100 to pass through. This inlet 7*g* is opened and closed by the inlet door unit 16.

The inlet door unit 16 includes an inlet door 19 and an inlet door opening and closing mechanism 20.

The inlet door 19 is a plate-shaped member disposed along an outer surface of the inlet wall 7*a*. The inlet door 19 closes the inlet 7*g* when being disposed at a closed position. In addition, the inlet door 19 opens the inlet 7*g* when being disposed at an open position. The inlet door 19 is provided with a sealing structure made of NBR (natural rubber), fluorine-containing rubber, etc., and configured to seal an atmosphere gas and a coolant in the heat treatment apparatus 1. The inlet door 19 is operated to open and close by the inlet door opening and closing mechanism 20.

The inlet door opening and closing mechanism 20 is formed, in the present embodiment, by using a fluid pressure cylinder, and includes a cylinder supported by the bottom portion 14 and a rod projecting from the cylinder and joined to the inlet door 19. According to a change in projecting amount of the rod from the cylinder, the inlet door 19 opens or closes. The inlet door 19 is sandwiched by a pair of front and rear guides 21 provided on an outer surface of the inlet wall 7*a* and extending vertically, and displacement of the inlet door 19 in the up-down direction Z1 is guided. In a state where the inlet door 19 is opened, the workpiece 100 that passed through the inlet 7*g* of the heating chamber 7 is conveyed to the inside of the heating chamber 7 by the heating chamber-side conveyance portion 11.

The heating chamber-side conveyance portion 11 is disposed inside the heating chamber 7. This heating chamber-side conveyance portion 11 is a belt conveyor type conveyance portion.

The heating chamber-side conveyance portion 11 includes a heating chamber-side motor 22 as a drive source disposed outside the heating chamber 7, an output transmitting member 23 that transmits an output of the heating chamber-side motor 22 from the outside of the heating chamber 7 to the inside of the heating chamber 7 at a predetermined fixed position, a drive shaft 25 and a driven shaft 26 to be rotated by the output transmitting member 23, and a pair of chains 27 (drive members) that are disposed inside the heating chamber 7 and displace the conveyance tray 2 in the conveyance direction A1 by receiving power from the output transmitting member 23.

The heating chamber-side motor 22 is, for example, an electric motor. The heating chamber-side motor 22 is disposed on a downstream side in the conveyance direction A1 in the heating chamber 7 at the rear (outer surface side) of the rear wall 7*d* of the heating chamber 7. A housing 22*a* of the heating chamber-side motor 22 is fixed to the rear wall 7*d* by using a fixing member such as a bolt. Between the housing 22*a* and the rear wall 7*d*, a sealing member (not shown) is disposed, and the sealing member seals airtightly a portion between the housing 22*a* and the rear wall 7*d*.

To an output shaft (not shown) of the heating chamber-side motor 22, one end portion of the output transmitting member 23 is joined rotatably in a coordinated manner. In detail, the output shaft of the heating chamber-side motor 22 is directed upward in the up-down direction Z1, and the output transmitting member 23 is directed in the front-rear direction Y1 (horizontal direction). These output shaft and output transmitting member 23 are joined rotatably in a coordinated manner via a mechanism of a gear pair with intersecting axes such as a bevel gear pair.

The output transmitting member 23 extends inside the heating chamber 7 through a hole portion 7*i* formed in the rear wall 7*d*, at a fixed position close to a lower portion of the heating chamber 7. To the other end portion of the output transmitting member 23, a sprocket is joined integrally rotatable. The drive shaft 25 is disposed adjacent to the output transmitting member 23. The drive shaft 25 is disposed on a downstream side of the heating chamber 7 in the conveyance direction A1. The drive shaft 25 extends along the front-rear direction orthogonal to the conveyance direction A1. To one end portion of the drive shaft 25, a sprocket is joined rotatably together. Around the sprocket of the output transmitting member 23 and the sprocket of the drive shaft 25, a chain 29 is wound. According to the configuration described above, an output of the heating chamber-side motor 22 is transmitted to the drive shaft 25.

The driven shaft 26 is disposed parallel to the drive shaft 25. The driven shaft 26 is disposed near the inlet 7*g* of the heating chamber 7. The drive shaft 25 and the driven shaft 26 are respectively supported rotatably by the bottom wall 7*f* via support members 28 and 28 including bearings, etc. To a pair of end portions of the drive shaft 25 in the front-rear direction Y1 and a pair of end portions of the driven shaft 26 in the front-rear direction Y1, sprockets are respectively joined rotatably together. Around these pairs of sprockets arranged side by side in the conveyance direction A1, chains 27 and 27 are wound. The pair of chains 27 and 27 are disposed away from each other in the front-rear direction Y1, and are configured to enable the frame portion 2*a* of the conveyance tray 2 to be placed on the pair of chains 27 and 27.

In the present embodiment, in the front-rear direction Y1, a distance between the chains 27 and 27 is set to be equal to or longer than an entire length of the workpiece 100. With the configuration described above, according to driving of the heating chamber-side motor 22, the output transmitting member 23 rotates, and this rotation is transmitted to one drive shaft 25. Then, this drive shaft 25 drives the chains 27 and 27 and rotates the driven shaft 26. That is, according to driving of the heating chamber-side motor 22, the pair of chains 27 and 27 rotate. Accordingly, the conveyance tray 2 on the pair of chains 27 and 27 are conveyed in the conveyance direction A1.

At an intermediate portion of the heating chamber 7 in the conveyance direction A1, the heating member 17 is disposed, and further, at a lower end portion of the heating chamber 7 and below the heating chamber 7, the second conveyance mechanism 18 is disposed. That is, the second conveyance mechanism 18 is disposed below the first conveyance mechanism 3 (horizontal conveyance mechanism). As described below, a part of the coolant passage 48 of the cooling device 6 is disposed at a height position lower than a height position of the heating chamber 7. Accordingly, the heat treatment apparatus 1 can be made more compact.

The heating member 17 is a member disposed away from the conveyance path B1 along a direction (up-down direction Z1) crossing the conveyance direction A1 in the heating chamber 7 to heat the workpiece 100. The heating member 17 is disposed, in the present embodiment, above the conveyance path B1. The heating member 17 is, in the present embodiment, an induction heating coil, and is configured to heat the workpiece 100 by induction heating.

The heating member 17 is configured by forming a conductive member such as copper in a spiral manner. A spiral portion of the heating member 17 is formed into a size capable of surrounding the workpiece 100. One end portion and the other end portion of the heating member 17 extend linearly rearward, and are supported by the rear wall 7*d*. One end portion and the other end portion of the heating member 17 are electrically connected to a power source (not shown), and is supplied with electric power from this power source. Below the heating member 17, the second conveyance mechanism 18 is disposed.

The second conveyance mechanism 18 is provided to move up and down the workpiece 100 between the conveyance tray 2 and the heating member 17 in the heating chamber 7.

The second conveyance mechanism 18 includes a support portion 18*a* to support the workpiece 100, and a support portion drive mechanism 30 to displace this support portion 18*a* between the conveyance tray 2 and the heating member 17.

The support portion 18*a* of the second conveyance mechanism 18 is provided to lift the workpiece 100 through the hole portion 2*c* formed in the conveyance tray 2, in the heating chamber 7. The support portion 18*a* is configured to move up and down between a predetermined standby position P1 and a heating position P2. The support portion 18*a* is formed by using a material with excellent heat resistance such as carbon, metal, or ceramic. The support portion 18*a* at the standby position P1 is disposed between the pair of chains 27 and 27 of the heating chamber-side conveyance portion 11. In the present embodiment, the support portion 18*a* is disposed at a substantially center of the heating chamber 7 in the conveyance direction A1.

The support portion 18*a* is shaped to become capable of lifting the workpiece 100 supported by the conveyance tray 2, without contact with the conveyance tray 2. In detail, the support portion 18*a* includes a shaft-shaped support portion main body 18*b*, and support portion arms 18*c* extending radially from the support portion main body 18*b*. The support portion main body 18*b* at a standby position P1 is disposed near the bottom wall 7*f* of the heating chamber 7.

The support portion arms 18*c* are disposed, for example, at even intervals in the circumferential direction of the support portion main body 18*b* so that the support portion arms 18*c* and the support portions 2*b* of the conveyance tray 2 that has reached a position above the standby position P1 are alternately arranged in the circumferential direction of the support portion main body 18*b*. At the center of the hole portion 2*c* of the conveyance tray 2, the components of the conveyance tray 2 are not disposed, and this configuration prevents the support portion main body 18*b* from coming into contact with the conveyance tray 2. The support portion main body 18*b* is joined to the support portion drive mechanism 30.

The support portion drive mechanism 30 is provided to displace the support portion 18*a* between the standby position P1 and the heating position P2. In the present embodiment, the support portion drive mechanism 30 is formed by using a screw mechanism. Examples of this screw mechanism include a so-called bearing nut mechanism configured by using a bearing as a nut on an outer circumference of a male threaded shaft, and a ball screw mechanism, etc.

Further, the support portion drive mechanism 30 includes a rotation mechanism to rotate the support portion 18*a* around a central axis of the support portion 18*a*. Note that, the detailed configuration of the support portion drive mechanism 30 is not limited as long as it can displace the support portion 18*a* in the up-down direction Z1, can hold the support portion 18*a* at the standby position P1 and the heating position P2, and can rotate the support portion 18*a* (workpiece 100) at the heating position P2.

The support portion drive mechanism 30 includes a main body portion 30*a*, a movable portion 30*b*, and a drive source 30*c*.

The main body portion 30*a* is disposed in a space below the heating chamber 7, and supported by the bottom portion 14. The main body portion 30*a* is disposed adjacent to a drive source 30*c* such as an electric motor. The drive source 30*c* is supported by the bottom portion 14. The main body portion 30*a* displaces the movable portion 30*b* in the up-down direction Z1 by receiving an output from the drive source 30*c*. The movable portion 30*b* is supported by the main body portion 30*a*, and extends upward from the main body portion 30*a*. The movable portion 30*b* is disposed to penetrate through a cylinder portion 31 fixed to the bottom wall 7*f* of the heating chamber 7 and penetrate through the bottom wall 7*f*. A bottom portion of the cylinder portion 31 is disposed to surround the movable portion 30*b*.

With the configuration of the support portion drive mechanism 30 described above, after the conveyance tray 2 and the workpiece 100 are conveyed to a position above the standby position P1 (below the heating member 17) by the heating chamber-side conveyance portion 11 of the first conveyance mechanism 3, the movable portion 30*b* of the support portion drive mechanism 30 moves upward. According to this movement, the support portion 18*a* moves upward from the standby position P1, lifts the workpiece 100, and further moves to the heating position P2. Then, by induction heating by the heating member 17, the workpiece 100 is heated to a predetermined carburization temperature.

At this carburizing, the movable portion 30*b* rotates the support portion 18*a* and the workpiece 100 around the central axis of the support portion 18*a* so that the workpiece 100 can be more uniformly inductively heated. When the operation of heating the workpiece 100 is completed, the movable portion 30*b* immobilizes the support portion 18*a* and the workpiece 100 at a predetermined rotation position (a position around the central axis of the support portion 18*a*). Positional control in this case is performed by a sensor and a control device that are not shown.

After the immobilizing, the movable portion 30*b* of the support portion drive mechanism 30 is moved downward, and accordingly, the support portion 18*a* and the workpiece 100 move downward from the heating position P2. Then, the workpiece 100 is placed on the support portions 2*b* of the conveyance tray 2. After that, the support portion 18*a* is further displaced downward to the standby position P1. For example, by a detection portion installed on the conveyance tray 2 and a sensor that detects a state of this detection portion, positional control of the support portion 18*a* in the up-down direction Z1 is performed. Accordingly, without heating the conveyance tray 2 by the heating member 17, heat treatment can be applied to the workpiece 100.

The conveyance tray 2 and the workpiece 100 after being subjected to heat treatment are conveyed to the intermediate door unit 5 side by the heating chamber-side conveyance portion 11.

The intermediate door unit 5 is configured to be capable of closing to seal airtightly and liquid-tightly between the outlet 7*h* formed in the outlet wall 7*b* of the heating chamber 7 and the inlet 8*g* formed in an inlet wall 8*a* of the cooling chamber 8, and to be capable of making these outlet 7*h* and inlet 8*g* open.

Referring to FIG. 6 to FIG. 8, the intermediate door unit 5 includes a frame portion 5*a*, an intermediate door 33, and an intermediate door opening and closing mechanism 34.

The frame portion 5*a* is a portion assuming a substantially rectangular frame shape as a whole disposed between the heating device 4 and the cooling device 6, and extends along the conveyance direction A1. The frame portion 5*a* is fixed to the outlet wall 7*b* of the heating chamber 7, and fixed to the inlet wall 8*a* of the cooling chamber 8.

The outlet wall 7*b* of the heating chamber 7 is provided as a wall portion dividing the heating chamber 7 and the cooling chamber 8. The outlet wall 7*b* of the heating chamber 7 is formed into, for example, a rectangular plate shape. At a portion closer to a lower portion of the outlet wall 7*b* of the heating chamber 7, the outlet 7*h* is formed. This outlet 7*h* is provided as a rectangular opening, and communicates with both of the space inside the heating chamber 7 and the space inside the cooling chamber 8. This outlet 7*h* is opened and closed by the intermediate door 33.

The intermediate door 33 is a plate-shaped member disposed along a side surface on the cooling chamber 8 side of the outlet wall 7*b*. The intermediate door 33 closes the outlet 7*h* of the outlet wall 7*b* by being disposed at a closed position. In addition, the intermediate door 33 opens the outlet 7*h* of the outlet wall 7*b* by being disposed at an open position. Accordingly, the intermediate door 33 is provided in the conveyance path so as to be switchable between a closed state and an opened state between the heating chamber 7 and the cooling chamber 8. The intermediate door 33 is provided with a sealing structure including NBR (nitrile rubber) and fluorine-containing rubber, etc., which is a configuration enabled to seal an atmosphere gas and a coolant between the heating chamber 7 and the cooling chamber 8. The intermediate door 33 is operated to open and close by the intermediate door opening and closing mechanism 34.

In the present embodiment, the intermediate door opening and closing mechanism 34 is formed by using a fluid pressure cylinder, and includes a cylinder 34*a* supported by an upper portion of the frame portion 5*a*, and a rod 34*b* projecting from the cylinder 34*a* and joined to the intermediate door 33. According to a change in projecting amount of the rod 34*b* from the cylinder 34*a*, the intermediate door 33 opens and closes. The intermediate door 33 is sandwiched by a pair of front and rear guides 35 provided on one side surface of the cooling chamber 8 side of the outlet wall 7*b* and extending vertically, and displacement of the intermediate door 33 in the up-down direction Z1 is guided by the guides 35. In a state where the intermediate door 33 is opened, the workpiece 100 that passed through the heating chamber 7 is conveyed to the inside of the cooling chamber 8 by the intermediate conveyance portion 13.

The intermediate conveyance portion 13 is supported by a lower portion of the frame portion 5*a* of the intermediate door unit 5, and disposed inside the cooling chamber 8. This intermediate conveyance portion 13 is, for example, a belt conveyor type conveyance portion.

The intermediate conveyance portion 13 includes a drive shaft 36, a driven shaft 37 disposed on an upstream side of the drive shaft 36 in the conveyance direction A1, and a pair of chains 38 and 38 (drive members) that displace the conveyance tray 2 in the conveyance direction A1 by receiving power from the drive shaft 36.

The driven shaft 37 and the drive shaft 36 extend along the front-rear direction orthogonal to the conveyance direction A1. The drive shaft 36 and the driven shaft 37 are respectively supported rotatably by the bottom portion of the frame portion 5*a* via a support member having a bearing, etc. To a pair of end portions of the drive shaft 36 in the front-rear direction Y1 and a pair of end portions of the driven shaft 37 in the front-rear direction, sprockets are respectively joined rotatably together. Around these pairs of sprockets arranged in the conveyance direction A1, chains 38 and 38 are wound. The chains 38 and 38 are disposed away from each other in the front-rear direction Y1, which are a configuration enabled to allow the frame portion 2*a* of the conveyance tray 2 to be placed on the chains 38. The drive shaft 36 is joined to a drive shaft 63 described below (refer to FIG. 12) via a chain 44, and is driven to rotate in accordance with rotation of the drive shaft 63.

The workpiece 100 conveyed to the inside of the cooling chamber 8 by the intermediate conveyance portion 13 configured as described above is subjected to cooling treatment by the cooling device 6.

Referring to FIG. 1 and FIG. 9 to FIG. 14, the cooling device 6 includes the cooling chamber 8, an outlet door unit 41, a coolant passage defining body 42, and a vertical displacement mechanism 43.

The cooling chamber 8 is disposed adjacent to the heating chamber 7 to cool the workpiece 100 provided with heat energy in the heating chamber 7. The cooling chamber 8 is formed into a substantially rectangular parallelepiped box shape vertically long. The cooling chamber 8 includes the inlet wall 8*a*, an outlet wall 8*b*, a front wall 8*c*, a rear wall 8*d*, a top wall 8*e*, and a bottom wall 8*f*.

The inlet wall 8*a* is a wall portion disposed to face the intermediate door 33 and extending vertically. In an upper portion of the inlet wall 8*a*, the inlet 8*g* is formed, and to this inlet 8*g*, the frame portion 5*a* of the intermediate door unit 5 is fixed. According to the configuration described above, the workpiece 100 that passed through the frame portion 5*a* of the intermediate door unit 5 is allowed to advance toward a downstream side of the cooling chamber 8 in the conveyance direction A1.

In the outlet wall 8*b*, an outlet 8*h* to carry the workpiece 100 out of the cooling chamber 8 is formed. The outlet 8*h* is disposed close to an intermediate portion of the outlet wall 8*b* in the up-down direction Z1, extends long and narrow from the front wall 8*c* side to the rear wall 8*d* side, and allows the workpiece 100 to pass through. This outlet 8*h* is opened and closed by the outlet door unit 41.

The outlet door unit 41 includes an outlet door 45 and an outlet door opening and closing mechanism 46.

The outlet door 45 is a plate-shaped member disposed along an outer surface of the outlet wall 8*b*. The outlet door 45 closes the outlet 8*h* by being disposed at a closed position. In addition, the outlet door 45 opens the outlet 8*h* by being disposed at an open position. The outlet door 45 is provided with a sealing structure including NBR, fluorine-containing rubber, etc., which is a configuration enabled to seal an atmosphere gas and a coolant inside the cooling chamber 8. The outlet door 45 is operated to open and close by the outlet door opening and closing mechanism 46.

In the present embodiment, the outlet door opening and closing mechanism 46 is formed by using a fluid pressure cylinder, and includes a cylinder 46*a* supported by the cooling chamber 8 on an outer surface of the outlet wall 8*b*, and a rod 46*b* projecting from the cylinder 46*a* and joined to the outlet door 45. According to a change in projecting amount of the rod 46*b* from the cylinder 46*a*, the outlet door 45 opens and closes. The outlet door 45 is sandwiched by a pair of front and rear guides 47 provided on the outer surface of the outlet wall 8*b* and extending vertically, and displacement of the outlet door 45 in the up-down direction is guided. In a state where the outlet door 45 is opened, the workpiece 100 that passed through the outlet 8*h* of the cooling chamber 8 is conveyed to the outside of the cooling chamber 8.

From the conveyance tray 2 that passed through the outlet 8*h*, the workpiece 100 is taken out. The conveyance tray 2 from which the workpiece 100 was taken out is conveyed to the inlet 7*g* side of the heating chamber 7 of the heating device 4 by a returning mechanism such as a belt conveyor, not shown in the drawings, provided to the first conveyance mechanism 3. According to the configuration of the first conveyance mechanism 3, the conveyance tray 2 is conveyed to circulate to the heating device 4 and the cooling device 6.

Inside the cooling chamber 8, the coolant passage defining body 42 is provided. The coolant passage defining body 42 is a unit to define a coolant passage 48 which supplies a predetermined coolant to the workpiece 100 that passes through the conveyance path B1 along the conveyance direction A1. In the present embodiment, cooling water is used as a coolant, however, oil or the like can be used instead of the cooling water.

The coolant passage defining body 42 includes a lower member 49 and an upper member 50 as a plurality of coolant passage defining members, an introduction pipe 51, and the conveyance tray 2. The conveyance tray 2 is disposed between the lower member 49 and the upper member 50 as the plurality of coolant passage defining members. That is, in the present embodiment, the conveyance tray 2 has both of a function of conveying the workpiece 100 and a function of defining a portion of the coolant passage 48. Also the conveyance tray 2 cooperates with the lower member 49 and the upper member 50, which is configured to define the coolant passage 48.

In the present embodiment, the lower member 49, the conveyance tray 2, and the upper member 50 are configured to define the coolant passage 48 in a state of housing the workpiece 100 by being displaced to approach each other along the up-down direction Z1 (crossing direction) crossing the conveyance direction A1, and to allow the workpiece 100 to be let into and out of the coolant passage 48 along the conveyance direction A1 by being displaced to separate from each other along the up-down direction Z1. The coolant passage 48 is provided to supply the coolant to the workpiece 100 inside the cooling chamber 8, and extends along the up-down direction Z1 (vertical direction).

The lower member 49 is provided as a cylindrical pipe extending upward from the bottom wall 8*f* of the cooling chamber 8. The lower member 49 is disposed at a substantially center of the cooling chamber 8 in a plan view. An upper end portion of the lower member 49 is disposed near the cooling chamber-side conveyance portion 12, and is configured to be positioned below the conveyance tray 2. To the lower member 49, the introduction pipe 51 is connected.

The introduction pipe 51 is provided to introduce the coolant from the outside of the cooling chamber 8 to the lower member 49. The introduction pipe 51 extends in the front-rear direction Y1. One end of the lower member 49 is connected to a lower end portion of the rear wall 8*d*. The lower member 49 penetrates through the rear wall 8*d* of the cooling chamber 8, and the other end of the lower member 49 is connected to a coolant tank not shown in the drawings. According to the configuration described above, the coolant pressure-fed from the coolant tank to the introduction pipe 51 by a pump (not shown) is introduced to the inside of the lower member 49, and injected upward. A discharge pipe 52 is provided adjacent to the introduction pipe 51.

The discharge pipe 52 is provided to discharge the coolant discharged from the inside to the outside of the coolant passage 48 in the cooling chamber 8, to the outside of the cooling chamber 8. The discharge pipe 52 is formed at a lower end portion of the rear wall 8*d* of the cooling chamber 8 at a position adjacent to the introduction pipe 51, and continued to the inside and the outside of the cooling chamber 8. The discharge pipe 52 is connected to the coolant tank not shown in the drawings, and a coolant is stored in this coolant tank. Above the lower member 49 adjacent to the discharge pipe 52, the upper member 50 is disposed.

The upper member 50 is provided as a member supported to float inside the cooling chamber 8. The upper member 50 is provided as a cylindrical pipe extending in the up-down direction Z1. At a lower end portion of the upper member 50, a flange portion 50*a* is provided. This upper member 50 is supported to be displaceable in the up-down direction Z1 by the vertical displacement mechanism 43.

The vertical displacement mechanism. 43 is provided to support the upper member 50 and a portion (chain unit 66 described below) of the cooling chamber-side conveyance portion 12 in a displaceable manner in the up-down direction Z1 with respect to the lower member 49. The vertical displacement mechanism 43 is configured to enable the upper member 50 and the chain unit 66 to move relative to each other in the up-down direction Z1. The vertical displacement mechanism 43 is configured to displace the upper member 50 downward to bring the upper member 50 into contact with the conveyance tray 2 when the conveyance tray 2 is disposed at a cooling position P4. The vertical displacement mechanism. 43 is supported by the top wall 8*e* of the cooling chamber 8, and is disposed to extend downward from the top wall 8*e*.

The vertical displacement mechanism 43 includes a base plate 55, suspended stays 56 and 56, a moving up/down mechanism 57, and guide shafts 58 and 58.

The base plate 55 is formed by using, in the present embodiment, a metal plate. This base plate 55 is disposed at a predetermined distance in the up-down direction Z1 from the opening at the upper end of the upper member 50. Accordingly, the coolant that was injected upward inside the upper member 50 can be prevented from being bounced by the base plate 55 and returned to the inside of the coolant passage 48. To an outer circumferential edge of an upper end of the base plate 55, the suspended stays 56 and 56 are fixed.

The suspended stays 56 and 56 are formed by using, in the present embodiment, metal plates. The suspended stays 56 and 56 are disposed, for example, away from each other in the front-rear direction Y1. Upper end portions of the respective suspended stays 56 and 56 are fixed to the base plate 55. Lower end portions of the respective suspended stays 56 and 56 are fixed to an upper end portion of the upper member 50. Accordingly, the upper member 50, the suspended stays 56 and 56, and the base plate 55 are configured to integrally move as a unit. The unit of these is displaced in the up-down direction Z1 by the moving up/down mechanism 57.

In the present embodiment, the moving up/down mechanism 57 is formed by using a fluid pressure cylinder, and includes a cylinder 57*a* supported by the top wall 8*e* of the cooling chamber 8, and a rod 57*b* projecting downward from the cylinder 57*a* and joined to a center of the base plate 55. The cylinder 57*a* is disposed outside the cooling chamber 8, and the rod 57*b* extends from a hole portion formed in the top wall 8*e* to the inside of the cooling chamber 8.

According to a change in projecting amount of the rod 57*b* from the cylinder 57*a*, the upper member 50, etc., are displaced in the up-down direction Z1. For example, two guide shafts 58 are provided, fixed to the base plate 55, and supported slidably in the up-down direction Z1 by guide shaft guide portions 59 formed on the top wall 8*e*. This realizes smoother displacement of the rod 57*b*.

Further, it is configured that the conveyance tray 2 is conveyed from the intermediate conveyance portion 13 to a predetermined conveyance position P3 by the cooling chamber-side conveyance portion 12.

Referring to FIG. 12 to FIG. 14, the cooling chamber-side conveyance portion 12 is disposed inside the cooling chamber 8. This cooling chamber-side conveyance portion 12 is a belt conveyor type conveyance portion.

The cooling chamber-side conveyance portion 12 includes a cooling chamber-side motor 61 as a drive source disposed outside the cooling chamber 8, an output transmitting member 62 that transmits an output of the cooling chamber-side motor 61 from the outside of the cooling chamber 8 to the inside of the cooling chamber 8 at a predetermined fixed position, a drive shaft 63 and a driven shaft 64 to be rotated by the output transmitting member 62, a pair of chains 65 and 65 that are disposed inside the cooling chamber 8, and displace the conveyance tray 2 in the conveyance direction A1 by receiving power from the output transmitting member 62, and a movable joint portion 67 to join a chain unit 66 including the drive shaft 63, the driven shaft 64, and the chains 65 and 65 to the upper member 50 in a relatively displaceable manner in the up-down direction Z1.

The cooling chamber-side motor 61 is, for example, an electric motor. The cooling chamber-side motor 61 is disposed on a downstream side in the conveyance direction A1 in the cooling chamber 8 at the rear side (outer surface side) of the rear wall 8*d* of the cooling chamber 8. The housing 61*a* of the cooling chamber-side motor 61 is fixed to a cylindrical motor bracket 68 by using a fixing member such as a bolt. This motor bracket 68 is fixed to the rear wall 8*d* by using a fixing member such as a bolt.

Between a portion of the motor bracket 68 facing the rear wall 8*d* and the rear wall 8*d*, a sealing member (not shown) is disposed, and as a result, between the housing 61*a* and the rear wall 8*d* are sealed airtightly. To an output shaft (not shown) of the cooling chamber-side motor 61, one end portion of the output transmitting member 62 is joined rotatably in an interlocking manner.

In detail, the output shaft of the cooling chamber-side motor 61 is directed in the up-down direction Z1, and the output transmitting member 62 is directed in the front-rear direction Y1 (horizontal direction). These output shaft and output transmitting member 62 are joined rotatably in an interlocking manner via a mechanism of a gear pair with intersecting axes such as a bevel gear pair.

The output transmitting member 62 extends to the inside of the cooling chamber 8 at a position on a downstream side in the conveyance direction A1 in the cooling chamber 8 through a hole portion 8*i* formed in the rear wall 8*d*. The output transmitting member 62 includes one end portion 62*a*, a universal joint 62*b*, an intermediate shaft 62*c*, a universal joint 62*d*, and an outer end portion 62*e*, and the one end portion 62*a*, the universal joint 62*b*, the intermediate shaft 62*c*, the universal joint 62*d*, and the other end portion 62*e* are arranged in this order. Thus, by including the universal joints 62*b* and 62*d*, the output transmitting member 62 can change the relative positions of the one end portion 62*a* and the other end portion 62*e*. In particular, in the present embodiment, the other end portion 62*e* can be displaced in the up-down direction Z1 with respect to the one end portion 62*a*.

To the other end portion 62*e* of the output transmitting member 62, the drive shaft 63 is joined rotatably together. The drive shaft 63 is disposed on a downstream side of the cooling chamber 8 in the conveyance direction A1. The drive shaft 63 extends along the front-rear direction Y1 orthogonal to the conveyance direction A1. Accordingly, an output of the cooling chamber-side motor 61 can be transmitted to the drive shaft 63.

The driven shaft 64 is disposed parallel to the drive shaft 63. The driven shaft 64 is disposed near the inlet 8*g* of the cooling chamber 8. Between the drive shaft 63 and the driven shaft 64, the lower member 49 is disposed. To a pair of end portions of the drive shaft 63 in the front-rear direction Y1 and a pair of end portions of the driven shaft 64 in the front-rear direction Y1, sprockets are respectively joined rotatably together. Around pairs of sprockets arranged in the conveyance direction A1, chains 65 and 65 are wound. The chains 65 and 65 are disposed away from each other in the front-rear direction Y1, which are a configuration enabled to allow the frame portion 2*a* of the conveyance tray 2 to be placed on. Between the chains 65 and 65, an upper end portion of the lower member 49 is disposed. Thus, the upper end portion of the lower member 49 is surrounded by the drive shaft 63, the driven shaft 64, and the pair of chains 65 and 65.

In the present embodiment, in the front-rear direction Y1, a distance between the chains 65 and 65 is set to be equal to or longer than an entire length of the workpiece 100. With the configuration described above, in accordance with driving of the cooling chamber-side motor 61, the output transmitting member 62 rotates, and this rotation is transmitted to the drive shaft 63. Then, this drive shaft 63 drives the chains 65 and 65 and rotates the driven shaft 64. That is, by driving the cooling chamber-side motor 61, the pair of chains 65 and 65 rotate. Accordingly, the conveyance tray 2 on the pair of chains 65 and 65 moves in the conveyance direction A1.

As described above, the drive shaft 63, the driven shaft 64, and the pair of chains 65 and 65 described above constitute the chain unit 66. This chain unit 66 is supported to be displaceable in the up-down direction Z1 by the movable joint portion 67. The chain unit 66 is configured to be capable of being joined to the vertical displacement mechanism 43 via the movable joint portion 67 and the upper member 50, and capable of being displaced to the conveyance position P3 and the cooling position P4.

The chain unit 66 at the conveyance position P3 supports the conveyance tray 2 so that the conveyance tray 2 is away from the upper member 50 and the lower member 49, and, the chain unit 66 at the cooling position P4 disposes the conveyance tray 2 so that the conveyance tray 2 comes into contact with the lower member 49.

The movable joint portion 67 includes a pair of beam portions 69 and 70, a plurality of brackets 71, and a plurality of guide receiving portions 72.

The pair of beam portions 69 and 70 are provided as beam-shaped portions extending along the conveyance direction A1. One beam portion 69 is disposed parallel to the chain 65 at the rear side (rear wall 8*d* side) of the chain 65, and supports one end portion of the drive shaft 63 and one end portion of the driven shaft 64 rotatably. The other beam portion 70 is disposed parallel to the chain 65 at the front side (front wall 8*c* side) of the chain 65, and supports the other end portion of the drive shaft 63 and the other end portion of the driven shaft 64 rotatably.

The pair of beam portions 69 and 70 are fixed to the plurality of brackets 71. The plurality of brackets 71 are provided to join the pair of beam portions 69 and 70 to the upper member 50. Each bracket 71 is formed into, for example, an L shape. The brackets 71 and 71 are fixed to both end portions in the conveyance direction A1 of one beam portion 69, and both ends of the one beam portion 69 are supported. To both end portions in the conveyance direction A1 of the other beam portion 70, the brackets 71 and 71 are fixed, and both ends of the other beam portion 70 are supported.

A lower end portion of each bracket 71 is fixed to a corresponding beam portion 69 or 70. In each bracket 71, a lower surface 71*a* of a portion extending horizontally is received by an upper surface of the flange portion 50*a* of the upper member 50. The brackets 71 can be displaced upward with respect to the flange portion 50*a*.

To lower end portions of the respective beam portions 69 and 70, guide receiving portions 72 are fixed. The guide receiving portions 72 are disposed at, for example, a plurality of positions (in the present embodiment, two positions) on each of the beam portions 69 and 70 in the conveyance direction A1. In each guide receiving portion 72, a guide hole portion 72*a* extending vertically is formed. In addition, a guide shaft 73 that can be fit in this guide hole portion 72*a* is provided.

The guide shaft 73 is provided for each guide hole portion 72*a*, and fixed to a corresponding one of lower portion stays 74 and 74. The lower portion stays 74 and 74 are fixed to the front wall 8*c* or the rear wall 8*d*. Each guide shaft 73 is fit in a corresponding guide hole portion 72*a* vertically slidably. Accordingly, movements of the pair of beam portions 69 and 70 in the up-down direction Z1 are guided.

To each of the lower portion stays 74 and 74, a stopper 75 is fixed. The stopper 75 is formed by using, for example, a bolt, and screw-coupled to a corresponding one of the lower portion stays 74 and 74. Accordingly, the position of the stopper 75 in the up-down direction Z1 can be adjusted.

Referring to FIG. 13 and FIG. 15, the stopper 75 on the rear wall 8*d* side faces a lower end portion of the beam portion 69 on the rear wall 8*d* side in the up-down direction Z1. On the other hand, the stopper 75 on the front wall 8*c* side faces a lower end portion of the beam portion 70 on the front wall 8*c* side in the up-down direction Z1. When the pair of beam portions 69 and 70 reach the predetermined cooling position P4, each of the beam portions 69 and 70 is received by a corresponding stopper 75, and is restrained from further moving downward.

On the front wall 8*c* and the rear wall 8*d*, upper portion stays 76 and 76 are respectively provided. To each of the upper portion stays 76 and 76, a stopper 77 is fixed. The stopper 77 is formed by using, for example, a bolt, and screw-coupled to a corresponding one of the upper portion stays 76 and 76. Accordingly, the position of the stopper 77 in the up-down direction Z1 can be adjusted.

The stopper 77 on the rear wall 8*d* side faces the bracket 71 of the beam portion 69 on the rear wall 8*d* side in the up-down direction Z1. On the other hand, the stopper 77 on the front wall 8*c* side faces the bracket 71 of the beam portion 70 on the front wall 8*c* side in the up-down direction Z1. When the pair of beam portions 69 and 70 reach the predetermined conveyance position P3, each bracket 71 is received by a corresponding stopper 77, and the pair of beam portions 69 and 70 are restrained from further moving upward.

With the configuration described above, when the upper member 50 lifts each bracket 71, the upper member 50 and the chain unit 66 are capable of being integrally displaced in the up-down direction Z1. When the upper member 50 is positioned at the conveyance position P3, the upper member 50 lifts the pair of beam portions 69 ad 70. In this state, the cooling chamber-side conveyance portion 12 receives the conveyance tray 2 from the intermediate conveyance portion 13 and conveys the conveyance tray 2 by operation of the chains 65 and 65. Then, the power transmitting member 62 is rotated by driving of the cooling chamber-side motor 61, and the drive shaft 63 accordingly rotates, and as a result, the chains 65 and 65 rotate.

When the conveyance tray 2 reaches the predetermined conveyance position P3, the chains 65 stop, and the conveyance tray 2 stops at the conveyance position P3. At this time, by operating the moving up/down mechanism 57 of the vertical displacement mechanism 43, the cylinder 57*b* is displaced downward. Accordingly, the upper member 50, the pair of beam portions 69 and 70, and the chain unit 66 are displaced downward. Then, as shown in FIG. 15 and FIG. 16, the pair of beam portions 69 and 70 are received by the lower stopper 75, and accordingly, the chain unit 66 is held at the cooling position P4. At this time, the rim portion of the hole portion 2*c* of the conveyance tray 2 is received by the upper end portion 49*a* of the lower member 49.

Then, when the rod 57*b* of the moving up/down mechanism 57 is further displaced downward, contact of the upper member 50 with the bracket 71 is released, and the lower end portion of the upper member 50 presses the conveyance tray 2 downward. Note that, in a groove formed on a lower surface of the flange portion 49*a* of the lower member 49, a sealing member such as an O-ring is disposed, and in a groove formed on an upper surface of the flange portion 50*a* of the upper member 50, a sealing member such as an O-ring is disposed.

Then, the conveyance tray 2 becomes sandwiched between the lower member 49 and the upper member 50, and the sealing members described above liquid-tightly seal the portions between the conveyance tray 2 and the upper member 50 and between the conveyance tray 2 and the lower member 49. Then, a coolant passage 48 is defined by the lower member 49, the conveyance tray 2, and the upper member 50. Thus, with the configuration in which the upper member 50 and the lower member 49 are brought into contact with the conveyance tray 2 from above and below, a stroke (vertical movement amount) of the upper member 50 can be reduced, so that the heat treatment apparatus 1 can be made more compact.

Referring to FIG. 14 to FIG. 16, the coolant passage 48 is a passage extending along the up-down direction Z1. This coolant passage 48 is defined by an inner circumferential surface of the introduction pipe 51, an inner circumferential surface of the lower member 49, an inner circumferential surface of the hole portion 2*c* of the conveyance tray 2, and an inner circumferential surface of the upper member 50, and is opened upward inside the cooling chamber 8. Inside the coolant passage 48, the workpiece 100 is surrounded by the upper member 50. Inside the coolant passage 48, a coolant flows from the lower side to the upper side toward the workpiece 100 supported by the support portions 2*b* of the conveyance tray 2.

Then, the workpiece 100 supported by the conveyance tray 2 is soaked in the coolant, and is cooled by the coolant. At this time, the support portions 2*b* of the conveyance tray 2 function as rectifying members to rectify the coolant in the coolant passage 48. This coolant reaches an upper end of the coolant passage 48 (an upper end of the upper member 50), and then reaches the outside of the coolant passage 48 and falls toward the bottom wall 8*f* of the cooling chamber 8. The coolant that fell onto the bottom wall 8*f* passes through the discharge pipe 52 attached to the rear wall 8*d*, and is returned to the coolant tank (not shown) outside the cooling chamber 8.

A flow volume, a flow rate, and a supply timing of the coolant to the coolant passage 48 are controlled by operation of a pump provided in a coolant storage tank (not shown). This enables, for example, uniform extinguishment of a vapor film on the workpiece 100 and cooling of the workpiece 100 without being pearlite and bainite nose. Uniform cooling while reducing the flow rate enables control of martensitic transformation timing. As a result, low-distortion treatment is enabled, and variation in heat deformation amount of the workpiece 100 can be reduced.

After cooling treatment is completed, the rod 57*b* of the moving up/down mechanism 57 of the vertical displacement mechanism 43 is displaced upward as shown in FIG. 12 to FIG. 15. Accordingly, the upper member 50 is displaced upward, and when the bracket 71 comes into contact with the flange portion 50*a* of the upper member 50, the bracket 71 and the chain unit 66 are displaced upward. Then, when the bracket 71 comes into contact with the stopper 77, operation of the moving up/down mechanism 57 stops.

Accordingly, the conveyance tray 2 is displaced upward together with the chain unit 66 and returned to the conveyance position P3. At this time, due to upward displacement of the upper member 50 with respect to the conveyance tray 2, the coolant inside the upper member 50 instantly falls to the outside of the upper member 50. Accordingly, the workpiece 100 surrounded by the upper member 50 can be quickly taken out from the coolant. Therefore, for example, marquenching that is effective for low-distortion treatment can also be easily performed.

Next, according to driving of the cooling chamber-side motor 61, the chains 65 and 65 of the chain unit 66 rotate, and the conveyance tray 2 moves to the outlet door 45 side. Then, the outlet door 45 is opened, and accordingly, the conveyance tray 2 and the workpiece 100 are carried out of the cooling chamber 8.

As described above, in the heat treatment apparatus 1, the workpiece 100 is supported by the conveyance tray 2, and this conveyance tray 2 is conveyed in the conveyance path B1 by the first conveyance mechanism 3. Accordingly, the first conveyance mechanism 3 conveys the workpiece 100 not directly but via the conveyance tray 2. Therefore, the first conveyance mechanism 3 can convey the conveyance tray 2 in a stable posture without being influenced by the shape of the workpiece 100. As a result, the workpiece 100 is conveyed in a more stable posture. In addition, by a simple configuration using the conveyance tray 2 for conveyance of the workpiece 100, the workpiece 100 is conveyed in a stable posture. Thus, by the simple configuration, the heat treatment apparatus 1 capable of more reliably conveying the workpiece 100 along the desired conveyance path B1 can be realized.

In addition, in the heat treatment apparatus 1, the second conveyance mechanism 18 to move the workpiece 100 between the conveyance tray 2 and the heating member 17 in the heating chamber 7 is provided. With this configuration, the workpiece 100 can be heated by the heating member 17. At the time of this heating, the workpiece 100 is away from the conveyance tray 2. Therefore, the conveyance tray 2 is prevented from being heated by the heating member 17 and the workpiece 100. Accordingly, defects of the conveyance tray 2 caused by heat distortion can be more reliably suppressed. Therefore, the life of the conveyance tray 2 (the number of times of reuse of the conveyance tray 2) can be improved. Further, a conveyance tray 2 that does not need to be heated can be prevented from being heated, so that through improvement in energy efficiency, energy for the heat treatment apparatus 1 can be further saved.

In the heat treatment apparatus 1, the heating member is disposed above the conveyance path B1. With this configuration, since the heating member 17 is disposed away from the conveyance path B1, the heat treatment apparatus 1 can be prevented from becoming long in the conveyance direction A1. In addition, since the heating member 17 is disposed above the conveyance path B1, heat from the heating member 17 is transferred to a portion above the heating member 17, and is prevented from being transferred to the conveyance path B1 side. Accordingly, the conveyance tray 2 can be more reliably prevented from being heated.

In the heat treatment apparatus 1, the second conveyance mechanism 18 includes a support portion 18*a* to lift the workpiece 100 through the hole portion 2*c* formed in the conveyance tray 2 in the heating chamber 7. With this configuration, by a simple operation of upward displacement with respect to the conveyance tray 2, the support portion 18*a* of the second conveyance mechanism 18 can lift the workpiece 100. Therefore, the configuration of the second conveyance mechanism 18 can be made simpler.

In addition, in the heat treatment apparatus 1, the coolant passage 48 extends along the up-down direction Z1 (vertical direction). With this configuration, since the cooling chamber 8 can be formed to be vertically long, the size of the heat treatment apparatus 1 in the horizontal direction can be reduced. The extending direction of the coolant passage 48 and the conveyance direction A1 are orthogonal to each other, so that the heat treatment apparatus 1 can be prevented from becoming excessively large in each of the horizontal direction and the vertical direction. Therefore, the heat treatment apparatus 1 can be made more compact.

In the heat treatment apparatus 1, the space between the heating chamber 7 and the cooling chamber 8 can be closed by the intermediate door 33. Accordingly, the atmosphere in the heating chamber 7 can be made more stable. In addition, a coolant inside the cooling chamber 8 can be more reliably prevented from flying into the heating chamber 7.

In the heat treatment apparatus 1, the first conveyance mechanism 3 is configured to circulate the conveyance tray 2 between the outside of the heating chamber 7, the heating chamber 7, the cooling chamber 8, and the outside of the cooling chamber 8. With this configuration, the conveyance tray 2 can be repeatedly used for conveyance of the workpiece 100 in the heat treatment apparatus 1. Therefore, the number of conveyance trays 2 necessary for heat treatment of a large number of workpieces 100 in the heat treatment apparatus 1 can be reduced. A possible number of times of reuse of the conveyance tray 2 is significantly increased by preventing the conveyance tray 2 from being heated.

In the heat treatment apparatus 1, since the heating chamber-side motor 22 of the first conveyance mechanism 3 is disposed outside the heating chamber 7, the heating chamber 7 can be made more compact. In addition, the output transmitting member 23 is configured so as not to move from a fixed position. Therefore, a portion that needs to be sealed between the inside and the outside of the heating chamber 7, that is, the portion between the output transmitting member 23 and the heating chamber 7 can be made smaller. Accordingly, the first conveyance mechanism 3 can be realized by a simple configuration.

In the heat treatment apparatus 1, the extending direction of the coolant passage 48 (up-down direction Z1) and the conveyance direction A1 of the workpiece 100 are different from each other. Accordingly, the shape of the heat treatment apparatus 1 can be prevented from becoming excessively long in any of the extending direction of the coolant passage 48 and the conveyance direction A1. Therefore, the heat treatment apparatus 1 can be made more compact. In addition, by displacing the upper member 50 and the lower member 49 as a plurality of coolant passage defining members relative to each other so as to separate from each other in the up-down direction Z1, the workpiece 100 can be let into and out of the coolant passage 48. Therefore, it is not necessary to provide a robot arm, etc., to let the workpiece 100 into and out of the coolant passage 48. Accordingly, the heat treatment apparatus 1 can be made more compact.

In addition, the heat treatment apparatus 1 is configured so that a cooling liquid as a coolant flows upward from the lower side in the coolant passage 48. With this configuration, the coolant passage defining body 42 can be formed to be vertically long, so that the size of the heat treatment apparatus 1 in the horizontal direction can be made smaller. In addition, the extending direction of the coolant passage 48 and the conveyance direction A1 are orthogonal to each other, so that the heat treatment apparatus 1 can be prevented from becoming excessively large in size in each of the horizontal direction and the vertical direction. Therefore, the heat treatment apparatus 1 can be made more compact. Further, in the coolant passage 48, a coolant flows upward from the lower side, so that the coolant can be more uniformly moved upward. Accordingly, the workpiece 100 can be more uniformly cooled.

In the heat treatment apparatus 1, the conveyance tray 2 defines a part of the coolant passage 48. Therefore, an exclusive member to support the conveyance tray 2 inside the coolant passage 48 is unnecessary, and the heat treatment apparatus 1 can be configured to be more compact and simpler.

In the heat treatment apparatus 1, the workpiece 100 is disposed at an intermediate portion of the coolant passage 48. To this workpiece 100, a coolant is supplied through the hole portion 2*c* of the conveyance tray 2. Accordingly, the workpiece 100 can be more reliably cooled by the coolant while being reliably supported inside the coolant passage 48.

In the heat treatment apparatus 1, by displacing the upper member 50 to the lower member 49 side by the vertical displacement mechanism 43, the coolant passage 48 is formed. In addition, by moving up the upper member 50 away from the lower member 49 by the vertical displacement mechanism 43, the workpiece 100 can be exposed from the coolant passage defining body 42. This enables letting-in and letting-out of the workpiece 100 along the conveyance direction A1.

In the heat treatment apparatus 1, the chain unit of the first conveyance mechanism 3 supports, at the conveyance position P3, the conveyance tray 2 so that the conveyance tray 2 is away from the upper member 50 and the lower member 49, and at the cooling position P4, disposes the conveyance tray 2 so that the conveyance tray 2 comes into contact with the lower member 49. With this configuration, when the chain unit 66 is disposed at the conveyance position P3, the chain unit 66 can support the conveyance tray 2 in a state where this conveyance tray 2 does not collide with other members. Accordingly, the conveyance tray 2 can be smoothly conveyed. On the other hand, when the chain unit 66 is disposed at the cooling position P4, the conveyance tray 2 can be disposed so that this conveyance tray 2 defines a coolant passage 48 in cooperation with the lower member 49. Thus, the vertical displacement mechanism 43 not only simply displaces the upper member 50 vertically with respect to the lower member 49, but also displaces the chain unit 66 and the conveyance tray 2 vertically.

In the heat treatment apparatus 1, the vertical displacement mechanism 43 is configured to displace the upper member 50 to bring the upper member 50 into contact with the conveyance tray 2 when the conveyance tray 2 is at the cooling position P4. With this configuration, by displacing the upper member 50 downward by the vertical displacement mechanism 43, the upper member 50 and the lower member 49 can be made to sandwich the conveyance tray 2. As a result, the coolant passage 48 can be defined by cooperation of the upper member 50, the conveyance tray 2, and the lower member 49.

In the heat treatment apparatus 1, the support portions 2*b* of the conveyance tray 2 function as rectifying members to rectify a coolant inside the coolant passage 48. With this configuration, a larger amount of coolant can be brought into uniform contact with the workpiece 100 per unit time, so that distortion of the workpiece 100 can be suppressed.

Figure 17:
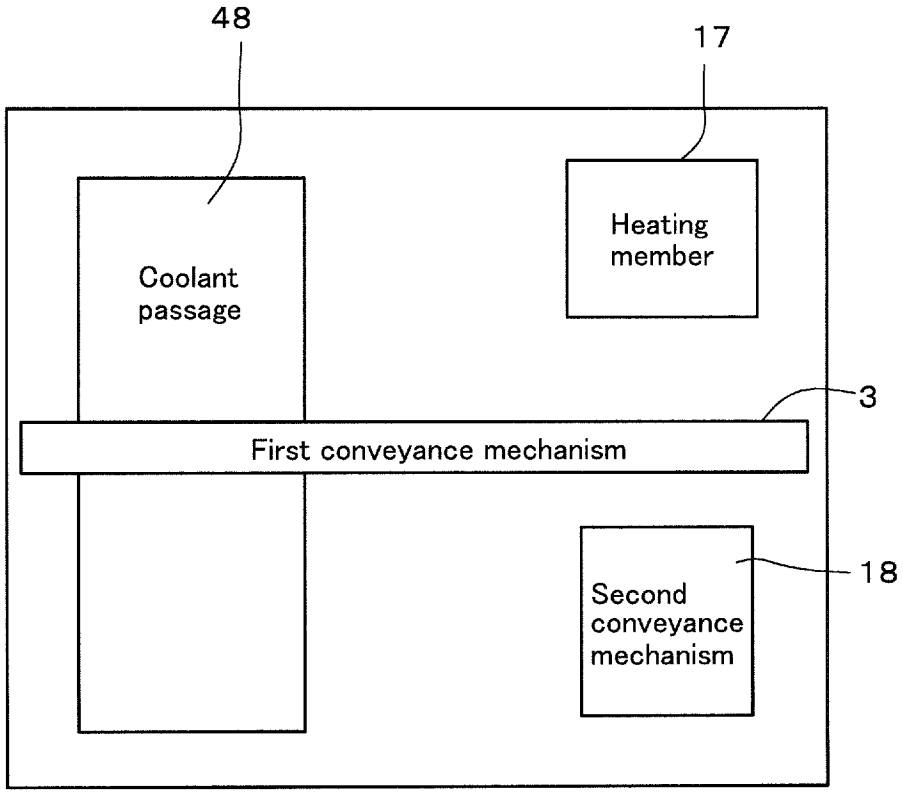
FIG. 17 is a schematic configuration diagram of the heat treatment apparatus to describe an effect of the heat treatment apparatus.

Referring to FIG. 17 as a schematic configuration diagram of the heat treatment apparatus 1 to describe the effects of the heat treatment apparatus 1, the coolant passage 48 is disposed across the first conveyance mechanism 3 vertically. In addition, vertically extending disposition of the coolant passage 48 is adopted, and disposition of the heating member 17 and the second conveyance mechanism 18 arranged one above the other is adopted. With this configuration, in the heat treatment apparatus 1, a layout compact in the up-down direction Z1 as well can be realized.

An embodiment of the present invention is described above, however, the present invention is not limited to the embodiment described above. The present invention can be variously modified within the scope of the claims.

For example, inside the coolant passage 48, a rectifying member such as a fin or a rectifying duct to rectify a coolant may be fixed. Accordingly, a coolant flowing direction around the workpiece 100 can be further uniformized.

INDUSTRIAL APPLICABILITY

The present invention can be widely applied as a heat treatment apparatus.

REFERENCE SIGNS LIST

1: Heat treatment apparatus
2: Conveyance tray
2*b*: Support portion to support workpiece (rectifying member)
2*c*: Hole portion to make coolant pass through
3: First conveyance mechanism (conveyance mechanism)
42: Coolant passage defining body
43: Vertical displacement mechanism
48: Coolant passage
49: Lower member (coolant passage defining member)
50: Upper member (coolant passage defining member)
66: Chain unit (unit)
100: Workpiece
A1: Conveyance direction
B1: Conveyance path
Z1: Up-down direction (crossing direction)

What is claimed is:

1. A heat treatment apparatus comprising: a coolant passage defining body to define a coolant passage to supply a predetermined coolant to a workpiece passing through a conveyance path along a predetermined conveyance direction; and a conveyance tray to convey the workpiece, wherein the coolant passage defining body includes a plurality of coolant passage defining members, the plurality of coolant passage defining members including a upper member and a lower member disposed below the upper member, the plurality of coolant passage defining member are configured to approach each other along a predetermined crossing direction crossing the conveyance direction to thereby define the coolant passage in a state of housing the workpiece, and separate from each other along the crossing direction to thereby allow the workpiece to be let into and out of the coolant passage along the conveyance direction, and in the state of housing the workpiece, the lower member, the conveyance tray, and the upper member are stacked in an up-down direction as the crossing direction such that the conveyance tray becomes sandwiched between the lower member and the upper member in the up down direction.

2. The heat treatment apparatus according to claim 1, wherein each of the upper member and the lower member are provided as a cylindrical pipe and configured to surround the workpiece entirely in a circumferential direction of the workpiece by the upper member and the lower member coming closely with each other in the up-down direction, and the conveyance tray includes a frame portion to be disposed between the upper member and the lower member and a support portion disposed inner side of the frame portion and configured to support the workpiece, and a hole portion formed at inner side of the frame portion and configured to make the coolant pass through.

3. The heat treatment apparatus according to claim 1, further comprising:

a conveyance mechanism to convey the conveyance tray along the conveyance direction, and a vertical displacement mechanism configured to displace the upper member along with the conveyance mechanism in the up-down direction relative to the lower member, wherein the vertical displacement mechanism displaces the upper member along with the conveyance mechanism holding the conveyance tray to the lower member side such that the lower member, the conveyance tray and the upper member are stacked in the up-down direction.

4. The heat treatment apparatus according to claim 3, wherein the conveyance mechanism includes a unit configured to be displaceable to a predetermined conveyance position and a predetermined cooling position by the vertical displacement mechanism, and the unit positioned at the conveyance position supports the conveyance tray so that the conveyance tray is away from the upper member and the lower member, and the unit positioned at the cooling position disposes the conveyance tray so that the conveyance tray comes into contact with the lower member.

5. The heat treatment apparatus according to claim 4, wherein the vertical displacement mechanism is configured to displace the upper member to bring the upper member into contact with the conveyance tray when the conveyance tray is positioned at the cooling position.

6. The heat treatment apparatus according to claim 1, further comprising:

a rectifying member to rectify the coolant inside the coolant passage.

* * * * *